US011817301B2

(12) United States Patent
Kholomeev et al.

(10) Patent No.: US 11,817,301 B2
(45) **Date of Patent: *Nov. 14, 2023**

(54) METHOD AND DEVICE FOR CROSSTALK COMPENSATION

(71) Applicant: Thermo Fisher Scientific (Bremen) GmbH, Bremen (DE)

(72) Inventors: Alexander Kholomeev, Bremen (DE); Gregor Quiring, Hamburg (DE); Frank Czemper, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/837,773

(22) Filed: Jun. 10, 2022

(65) Prior Publication Data

US 2022/0301841 A1 Sep. 22, 2022

Related U.S. Application Data

(62) Division of application No. 17/156,373, filed on Jan. 22, 2021, now Pat. No. 11,361,952, which is a (Continued)

(30) Foreign Application Priority Data

Dec. 22, 2017 (GB) ..... 1721730.8

(51) Int. Cl.
*H01J 49/00* (2006.01)
*H01J 49/42* (2006.01)
(Continued)

(52) U.S. Cl.
CPC ..... *H01J 49/0036* (2013.01); *H01J 49/027* (2013.01); *H01J 49/282* (2013.01); *H01J 49/4245* (2013.01); *H01J 49/425* (2013.01)

(58) Field of Classification Search
CPC .... H01J 49/0036; H01J 49/027; H01J 49/282; H01J 49/4245; H01J 49/425
(Continued)

(56) References Cited

U.S. PATENT DOCUMENTS 9,035,245 B2 5/2015 Glasmachers et al.
10,903,061 B2 * 1/2021 Kholomeev ..... H01J 49/4245
(Continued)

FOREIGN PATENT DOCUMENTS

CN 101405829 A 4/2009
CN 104170052 A 11/2014
(Continued)

OTHER PUBLICATIONS

Aliman M., et al., "A Novel Electric Ion Resonance Cell Design with High Signal-To-Noise Ratio and Low Distortion for Fourier Transform Mass Spectrometry", Journal of the American Society for Mass Spectrometry, Oct. 1999, vol. 10, No. 10, pp. 1000-1007.
(Continued)

*Primary Examiner* — Nicole M Ippolito
(74) *Attorney, Agent, or Firm* — Thomas F. Cooney

(57) ABSTRACT

A signal processing unit comprises: at least one data signal input line adapted to receive a measured data signal generated by an image current, the measured data signal comprising an added crosstalk signal induced by a source of electromagnetic disturbance; at least one disturbance signal input line adapted to receive a decoupled disturbance signal, extracted from the source of electromagnetic disturbance; an output line adapted to supply a compensated data signal; a conditioning module, to which the decoupled disturbance signal is supplied via the disturbance signal input line and which provides a compensation signal; and an adding module, to which the measured data signal and the compensation signal are provided and in which the measured data signal
(Continued)

and the compensation signal are superposed, whereby the decoupled disturbance signal is conditioned by the conditioning module such that the compensation signal essentially corresponds to an inverted added crosstalk signal.

10 Claims, 17 Drawing Sheets

Related U.S. Application Data division of application No. 16/202,861, filed on Nov. 28, 2018, now Pat. No. 10,903,061.

(51) Int. Cl.
*H01J 49/02* (2006.01)
*H01J 49/28* (2006.01)

(58) Field of Classification Search
USPC ..... 250/281, 282, 283
See application file for complete search history.

(56) References Cited

U.S. PATENT DOCUMENTS

| | | | | |
|---|---|---|---|---|
| 11,222,774 | B2 | 1/2022 | Kozhinov et al. | |
| 11,361,952 | B2 * | 6/2022 | Kholomeev | H01J 49/4245 |
| 2006/0187974 | A1 | 8/2006 | Dantus | |
| 2012/0248308 | A1 | 10/2012 | Makarov et al. | |
| 2014/0339424 | A1 | 11/2014 | Glasmachers et al. | |
| 2021/0210330 | A1 | 7/2021 | Verenchikov | |

FOREIGN PATENT DOCUMENTS

| | | | |
|---|---|---|---|
| DE | 4433478 | C2 | 7/1997 |
| WO | WO-2013104004 | A1 | 7/2013 |
| WO | WO-2017194333 | A1 | 11/2017 |

OTHER PUBLICATIONS

Schmidt et al., "High Voltage RF Generator and Compensation Network for a FFT Ion Trap Mass Spectrometer", International Conference on Applied Electronics (AE), Pilsen, Oct. 2, 2017, pp. 1-4.

* cited by examiner

METHOD AND DEVICE FOR CROSSTALK COMPENSATION

CROSS-REFERENCE TO RELATED APPLICATION

This application is a divisional, under 35 U.S.C. § 121, of U.S. patent application Ser. No. 17/156,373, now U.S. Pat. No. 11,361,952, filed on Jan. 22, 2021, which is a divisional of U.S. patent application Ser. No. 16/202,861, now U.S. Pat. No. 10,903,061, which was filed on Nov. 28, 2018 and which claims the priority benefit under 35 U.S.C. § 119(a) to British Patent Application No. 1721730.8, filed on Dec. 22, 2017, the disclosures of each of the foregoing applications hereby incorporated herein by reference.

TECHNICAL FIELD

The invention is directed to a method for eliminating a crosstalk signal added to a measured data signal, which is generated by an image current. The added cross talk signal is induced to the measured data signal by a source of electromagnetic disturbance. Further, a signal-processing unit is provided to implement the method. Additionally, the invention is directed to Fourier transform mass spectrometers, in which the method of eliminating an added crosstalk signal can be applied.

BACKGROUND

Indirect measurements of electrical charges can be done by the effect of an image current induced to a measuring electrode. The electrical charges can be associated to electrons, charged atoms, or molecules, which can be in a gaseous, liquid or solid state. Charged atoms or molecules are called ions and can have a specific charge state, when they have a charge q, which is equal to z times the elementary charge e (e=1,602192 *10-19 C). Then, z is the charge number of the charge state.

$$q=z*e \qquad \text{Eq. 1}$$

In particular, periodic image currents can be detected from charged particles with a periodic motion. The angular frequency w of such currents, which is correlated to the period T of the motion by $$\omega = \frac{2\pi}{T} \qquad \text{Eq. 2}$$

can be found as an accordingly periodic signal in the image current of the angular frequency ω.

In the following, Fourier transform mass spectrometry is briefly discussed. A detection unit in a Fourier transform mass spectrometer analyser is one example of a device that measures image currents with periodic signals correlated to a periodic motion of ions. A sample material in a form of ionized substances, injected into a working chamber and exposed to a magnetic, electric and/or an electromagnetic field becomes separated by mass. The ions, rotating in a working chamber, induce an image current in the detector unit of the Fourier transform mass spectrometer. The detector unit is then providing a measured data signal generated by the induced image current.

One specific embodiment of Fourier transform mass spectrometer comprises an Orbitrap® mass analyser, which is a type of electrostatic trap mass analyser and which comprises a pair of bell-shaped electrodes and a spindle-shaped central electrode. The electric field between the electrodes is used to capture and confine ions inside. The Orbitrap® mass analyser is described in detail in WO 96/30930, which is hereby included as part of this description.

RF signal generators are often used to supply ion optics in Fourier transform mass spectrometers. Exemplarily, the ions are trapped in a curved linear trap. called C-trap, before they are injected to the Orbitrap® mass analyser. To trap the ions in the curved linear trap inter alia RF voltages are applied. Since the curved linear trap is located near the outer bell-shaped electrodes of the Orbitrap® mass analyser, which are detecting an image current of the ions oscillating in the mass analyser, the RF signal might be unintentionally interfering with the measured ion signal generated by the image current.

To decode information from the measured data signal of the Fourier transform mass spectrometer, Fourier transform can be used. The Fourier transform is a mathematical operation that decomposes a signal into its sinusoidal parts, called modes with its angular frequencies w. Any analogous signal can be represented in this form. More generally, the Fourier transform produces a frequency frame from a time frame. After applying this transform, the angular frequencies w of the oscillating particles can be read out.

Knowing the angular frequencies, the mass can be found for Orbitrap® mass analysers as follows:

$$\omega = \sqrt{\frac{q}{m} \times k}, \qquad \text{Eq. 3}$$

where ω is the angular frequency, m/q is the mass-to charge ratio of an ion and k is the instrumental constant.

Knowing the angular frequencies, the mass can be found for ion cyclotron resonance (ICR) mass analysers as follows:

$$\omega = \frac{q*B}{m}, \qquad \text{Eq. 4}$$

where ω is the angular frequency, m/q is the mass-to charge ratio of an ion and B is the applied magnetic field.

In should be emphasized, that image current is a very small current, which has to be measured with electrodes of high impedance and has also be amplified with an amplifier of high impedance. Therefore, due to the high impedance the measurement in a detector unit is much more influenced by an electromagnetic disturbance in comparison to other detector systems not using image currents. Details how to detect image currents in Fourier transform mass spectrometers are described in EP 2 372 747 A1, which is incorporated to this description by reference.

In the following, electromagnetic disturbance and its crosstalk with other electromagnetic signals are briefly discussed. An electromagnetic disturbance is an electromagnetic signal, also called radio-frequency signal when in the radio frequency spectrum, which is generated and emitted by a source, referred to here as the source of the electromagnetic disturbance. The electromagnetic disturbance can interact with another electromagnetic signal e.g. in an electrical circuit or a detector unit measuring the electromagnetic signal. Note, that as used herein, the term "electromagnetic" is not limited to the case when electric and magnetic forces are involved. The term electromagnetic also encompasses the terms electrical, electronic and magnetic, because it should describe all effects that might occur in the field of electromagnetism, which is governed in general by the Maxwell equations. In particular, the interaction of the electromagnetic disturbance with another electromagnetic signal, called crosstalk, can be for example electromagnetic induction, electromagnetic interference, electromagnetic superposition, electromagnetic coupling including electrodynamic coupling, in particular capacitive coupling, magnetic coupling, conduction and combinations of these. The interaction can be intentional or unintentional. The intentional sources of an electromagnetic disturbance can comprise, for example, RF signal generators and their applied voltages to electrodes e.g. in mass spectrometers. The unintentional sources of an electromagnetic disturbance can comprise, for example, mechanical vibrations of pumps, e.g. converted to voltage oscillations on the electrodes detecting the image current.

The electromagnetic disturbance and the associated crosstalk can cause great disturbances to precise measuring electronics of detector units detecting a measured data signal generated by an image current. These electronics are using low level electrical currents deduced from the image current for measurement. The resulting measured data signal is encoded in a form of analogous signal. In other words, this measured information is encoded in the amplitude of the measured currents, changing with time. The crosstalk with an electromagnetic disturbance can produce unexpected changes in the measured data signal, disturbing the information encoded in it via the Fourier transformation, the angular frequency w and the phase of the sinusoidal components of the measured amplitude can be derived.

In particular, crosstalk can induce extra modes having their own angular frequency w and phase into the measured data signal. Those modes can be mistakenly interpreted as masses in the Fourier transform mass spectrometers. To avoid that, a compensation can be used.

A few attempts were made to tackle the problem discussed above.

WO 2012/152949 A1 describes a mass analyser in which ions form packets that oscillate with a period has an ion detector. The ion detector comprises: a detection arrangement and compensation circuitry. The detection arrangement may comprise: a plurality of detection electrodes detecting image current signals from ions in the mass analyser; and a preamplifier, providing an output based on the image current signals. The compensation circuitry provides a compensation signal to a respective compensatory part of the detection arrangement, based on one or more of the image current signals. A capacitance between each of the compensatory parts of the detection arrangement and a signal-carrying part of the detection arrangement affects the signal-to-noise ratio of the preamplifier output.

Therefore, the detection limit is improved by decreasing the capacitance of the detection circuit via the compensation circuitry. The above application discloses one way of reducing crosstalk in mass spectrometry.

JP 2001-183441 A describes a device adapted to improve accuracy of gain setting of a receiving system by interrupting an unwanted signal from an antenna at operational time by means of an automatic noise-level control circuit. The invention discloses a transceiver for a radar which is configured to effectively block unnecessary signals (such as, for example, jamming) when the automatic noise leveling circuit is in operation. Generally, the prior art concerns either different methods of noise reduction in mass spectrometers, or, general ways of reducing electromagnetic noise in different systems.

SUMMARY

In light of the outlined problems caused by the crosstalk due to the electromagnetic disturbance, it is the object of the present invention to disclose a method and device for compensating unwanted electromagnetic disturbance signals in measured data signals generated by an image current, particularly in Fourier transform mass spectrometry (FTMS). It is further the object of the present invention to improve data signal generated by image current in FTMS. It is also the object of the present invention to improve data acquisition in FTMS by reducing or eliminating signals due to electromagnetic crosstalk. It is also the object of the present invention to provide a method, a device and a system for deriving mass spectra in FTMS without also obtaining peaks due to noise signals. Furthermore, it is the object to allow for detection of mass peaks that otherwise would be obscured by peaks due to electromagnetic disturbance. It is further the object of the present invention to provide a way to extract and condition a disturbance signal in order to eliminate it from the measured data signal.

The present invention is specified in the claims as well as in the below description. Preferred embodiments are particularly specified in the dependent claims and the description of various embodiments.

In a first aspect of the invention, a method for eliminating an added crosstalk signal from a measured data signal generated by an image current is disclosed. The method comprises extracting a decoupled disturbance signal from a source of electromagnetic disturbance which is inducing the added crosstalk signal. The method also comprises conditioning the decoupled disturbance signal via a conditioning module by applying a phase shift and/or an amplitude amplification to obtain a compensation signal. The method further comprises providing the measured data signal and the compensation signal to an adding module, in which the measured data signal and the compensation signal are superposed. The compensation signal is conditioned by the conditioning module in such a way, that it essentially corresponds to the inverted signal of the added crosstalk signal.

Note, that "eliminating" can refer herein to sufficiently reducing it. In particular, the crosstalk signal is then no longer detectable within the measured data signal. This is also further explained below.

The added crosstalk signal can refer to a signal produced by a source of electromagnetic disturbance and inadvertently interfering with the measured data signal. In other words, the added crosstalk signal can refer to the variation of a measured data signal originating from electromagnetic crosstalk between a source of electromagnetic disturbance and further devices (such as, for example, a detector in which a measured data signal is measured).

The measured data signal can refer to an electromagnetic signal measured by a detector or another piece of equipment. This signal is the actual signal measured. It may comprise not just useful information obtained from certain experiments, but also noise due to crosstalk with other equipment.

The image current refers herein to the current induced by the motion of charge particles like ions, in particular inside a mass analyser of a Fourier transform mass spectrometer. The image current is then translated into the measured data signal by the detector unit.

In the above and in the following, extracting a decoupled disturbance signal from a source of an electromagnetic disturbance means, that a further signal of the source of the electromagnetic disturbance can be extracted or derived from the source of an electromagnetic disturbance, which correlates to the electromagnetic disturbance emitted by the source of electromagnetic disturbance. The further signal, referred to in the further description and claims as a decoupled disturbance signal, is therefore decoupled via an additional extraction device. Details about extraction devices that can be used and the according methods of extraction are described below.

Additionally to the decoupled disturbance signal, also a static signal or a signal of angular frequencies not relevant for the use of the measured data signal of the detector unit can be extracted from the source of electromagnetic disturbance by the extracting device. For the present invention, these additional signals are not relevant. According to the teaching of the invention, it is only important to condition the decoupled disturbance signal of the source of an electromagnetic disturbance in an appropriate manner, so that the added crosstalk signal induced by electromagnetic disturbance of the source of electromagnetic disturbance is eliminated from the measured data signal of the detector unit.

It has been found, that the decoupled disturbance signal and the added crosstalk signal, which is superposed to the measured data signal have the same angular frequency ωdist. Therefore, the interaction of electromagnetic disturbance with a detector unit (detecting a measured data signal generated based on a measured image current) results in a signal of the same angular frequency ωdist as the added crosstalk signal which is superposed to the measured data signal. With which intensity the signal is superposed is depending on the specific properties of the used detection unit and the kind of electromagnetic disturbance. Therefore, the amplitudes of the decoupled disturbance signal and the added crosstalk signal may deviate from each other. Further, the two signals might have a phase shift with respect to each other. Such phase shift may have different kinds of origin, which may be related to the source of the electromagnetic disturbance, the detector unit, the used extraction device, the used conditioning module, the used adding module and also the electrical lines connecting these components.

Conditioning in general can refer to any kind of modifying a signal. In the inventive method of claim 1, the conditioning of the decoupled disturbance signal is applied by only two specific kinds of modifying the signal, a phase shift of the decoupled disturbance signal and an amplitude amplification of the decoupled disturbance signal. Phase shift and amplitude amplification can be used as a single measure, or, they can be applied either in parallel or one after the other or also as a sequence of these two measures in which both measures can be applied several times.

Providing the signal can refer to guiding the signal via a circuit (or inputting a signal that was previously stored).

Superposing the measured data signal and the compensation signal can refer to adding or combining the two signals. This can be done directly in a circuit via, for example, a common junction that the signals are led to in the adding module, and/or via software that adds the two stored signals. Note, that in the case where more than one decoupled disturbance signals are extracted from various sources of electromagnetic disturbance, "combining" can refer to adding all of them, either step by step or at the same time (for example, multiple junctions, each for one compensation signal, can be provided in the adding module, and the measured data signal can be led to each of the junctions to have each of the compensation signals added to it progressively). The superposing adds the two signals by amplitude, which is a specific kind of interference. Therefore, it is important that the phase shift between the two signals is close to 180°, so that they can nearly cancel each other. In other words, it is desired that destructive interference between the added crosstalk signal and the compensation signal occurs.

Furthermore, the feature "the compensation signal . . . essentially corresponds to an inverted signal of the added crosstalk signal" should be interpreted as the compensation signal being essentially equal to the added crosstalk signal with a 180° phase shift applied to it (so that the compensation signal can cancel out the added crosstalk signal upon addition of the two by destructive interference). The quantifier "essentially" should be taken to mean both "approximately", "nearly", or "substantially" equal, as well as equal. That is, the compensation signal can be exactly equal to the added crosstalk signal (except for the inversion). However, the compensation signal need not be exactly equal to the added crosstalk signal as long as it cancels it sufficiently for further work with a compensated data signal. That is, "essentially" refers to a degree of similarity between the signals that is "good enough" for obtaining an undisturbed data signal. The amount of maximal acceptable difference between the added crosstalk signal and the compensation signal can of course differ on a case-by-case basis, but, for exemplary purposes, some values are given. Preferably, the added crosstalk signal and the compensation signal differ in phase by up to 1° (notwithstanding the 180° phase shift to obtain an opposite signal for cancelling the two)(additional sup values 2°, 5° ?, and in amplitude by a factor of two. However, the method is still applicable for the two signals differing by as much as 10 to 20% in phase (again, excluding the 180° phase shift), or, alternatively, up to 30°. (values to be discussed) As mentioned above, the numbers are exemplary, as they can depend on the relative strength of the added crosstalk signal and the unmodified data signal (data signal as it would be without any crosstalk). Note, that smaller intensity (and therefore smaller amplitude) of the added crosstalk signal can allow for a larger phase deviation between it and the compensation signal. Similarly, smaller frequency of the added crosstalk signal can also allow for a larger phase offset. This is due to the fact that such added crosstalk signals would interfere with the data signal less, even without being compensated by the compensation signal.

The present method can be used to eliminate unwanted electromagnetic signals (that is, electromagnetic interference by crosstalk) caused by various equipment (sources of electromagnetic disturbance) and interfering with the data signal that is being measured (measured data signal). It can be particularly advantageous to detect the electromagnetic disturbance directly at its source by the extraction device, so that its shape and amplitude can be inverted and combined with the measured data signal to eliminate the part of it generated by the noise sources (that is, sources of electromagnetic disturbance). In this way, precise and targeted electromagnetic noise reduction or elimination can be achieved to yield more meaningful and useful data signals.

In some embodiments, the measured data signal can be detected by a detection unit of a Fourier transform mass spectrometer. That is, the method can be preferably used as part of a mass spectrometry analysis. The measured data signal can be originating from the ions of a sample to be analysed with a mass spectrometer. In mass spectrometry, many sources of electromagnetic noise (that is, sources of electromagnetic disturbance) arise in experimental setup. For example, quadrupole mass analysers can generate electromagnetic signals that can interfere with the measurement of the sample composition—it would be very advantageous to filter out this noise. Furthermore, RF voltage supply of quadrupole electrodes, can serve as a source of electromagnetic disturbance, as well as vibrations of vacuum pumps and other supplies RF voltages, such as those of ion optics and/or AC/DC converter.

In some embodiments, the extraction of the decoupled disturbance signal can be performed by means of an extraction device. In some such embodiments, the extraction device can be a line comprising an impedance component adapted to taper a voltage supplied by a source of electromagnetic disturbance or to a source of an electromagnetic disturbance. The impedance component can comprise resistive, inductive and/or capacitive portions.

Additionally or alternatively, the extraction device can comprise an antenna that is exposed to the electromagnetic disturbance. By crosstalk, this can induce a signal in the antenna. This signal can be used as a decoupled disturbance signal in the inventive method.

Additionally or alternatively, the extraction device can comprise a winding, which is inductively coupled with a transformer, transforming a signal of the source of an electromagnetic disturbance.

A combination of several different (or same) extraction devices can also be used to extract multiple decoupled disturbance signals from different sources of electromagnetic disturbance. Hereby, each extraction device is extracting the decoupled disturbance signal of one source of electromagnetic disturbance. This can be particularly advantageous, as the measured data signal can include the sum of a plurality of added crosstalk signals induced by the different sources of electromagnetic disturbance in it, and extracting decoupled disturbance signals for each source of electromagnetic disturbance separately ensures that they can be individually subtracted from the measured data signal.

In some embodiments, the phase shift can comprise an inversion and a first additional phase shift of the decoupled disturbance signal. That is, the decoupled disturbance signal can be inverted (so that it cancels the crosstalk signal measured as part of the measured data signal at a later stage) and phase shifted to better match the undesirable crosstalk signal incorporated in the measured data signal.

In some embodiments, the phase shift can comprise an inversion and a first additional phase shift and a second additional phase shift of the decoupled disturbance signal. The second phase shift can provide a more precise adjustment that allows for fine-tuning the extracted crosstalk signal to the one incorporated into the data signal. Use of standard terms is missing In some embodiments, at least one of the phase shift and the amplitude amplification applied to the decoupled disturbance signal can be digitally controlled. Software control can also be an option.

In some embodiments, the method can further comprise the step of providing at least one compensated data signal from the adding module to which the measured data signal and the compensation signal are supplied to a data receiving device for further use. That is, the compensated data signal without the added crosstalk signal can be stored for further analysis and use. This is, of course, optional, and the compensation signal need not be stored before being used to obtain a compensated data signal.

In some embodiments, the adding module can provide the measured data signal and the compensation signal to one junction in order to combine them. That is, the two signals can be superposed where they meet, so that the two signals are added at the single junction. Additionally or alternatively, multiple junctions can be present, particularly for the cases where multiple added crosstalk signals are present due to different sources of electromagnetic disturbance.

In some embodiments, the measured data signal can be obtained by using a detector unit, which is part of a mass spectrometer having a mass analyser trapping ions by electrostatic electrodes. For example, in Fourier transform mass analysers, the detector unit is detecting an image current of oscillating ions.

In some embodiments, at least one of the decoupled disturbance signal, and/or the compensation signal, and/or the measured data signal can be an analogous signal.

In a second aspect of the invention, a signal processing unit is disclosed, which can be used to execute the above described inventive method. The signal processing unit comprises at least one measured data signal input line adapted to receive a measured data signal generated by an image current, wherein the measured data signal comprises an added crosstalk signal induced by a source of electromagnetic disturbance. The signal-processing unit also comprises at least one disturbance signal input line adapted to receive a decoupled disturbance signal extracted from the source of electromagnetic disturbance by an extraction device. The signal-processing unit further comprises an output line adapted to supply a compensated data signal to at least one data-receiving device. The signal-processing unit also comprises a conditioning module, to which the decoupled disturbance signal is supplied via the disturbance signal input line and which provides a compensation signal. The signal processing unit further comprises an adding module, to which the measured data signal and the compensation signal are provided and in which the measured data signal and the compensation signal are superposed. The decoupled disturbance signal is conditioned by the conditioning module in such a way, that, the compensation signal essentially corresponds to the inverted added crosstalk signal.

In other words, the signal processing unit can be configured to receive a data signal (the measured data signal) which includes a crosstalk signal (added crosstalk signal) in it. The signal-processing unit is also configured to receive another signal from the source of the electromagnetic disturbance (decoupled disturbance signal) and transform it in such a way that it becomes at least essentially the inverted signal of the added crosstalk signal superposed with the measured data signal. The measured data signal and this transformed other signal of the source of the electromagnetic disturbance (compensation signal) are then superposed in the signal processing unit, so that the crosstalk incorporated in the data signal is at least suppressed by the compensation signal.

The signal-processing unit can comprise a computer-implemented non-transient medium such as a specific software application configured to execute the functions described above and below. That is, the signal-processing unit can be mostly or fully implemented as an algorithm that is part of a computer program. In this way, the signal-processing unit can be implemented as part of software controlling a mass spectrometer, specifically the part that is responsible for reducing or eliminating any added crosstalk signals.

In some embodiments, the data signal input line can be connected to a detector unit of a Fourier transform mass spectrometer supplying the measured data signal. As described above, the present method can be particularly useful and advantageous for Fourier transform mass spectrometry and presents a new way of reducing or even removing mass to charge peaks in mass spectra, which are induced via electromagnetic disturbance and not by measured ions to obtain a more pronounced measurements of sample composition.

In some embodiments, the disturbance signal input line can be connected to the extraction device extracting the decoupled disturbance signal from the source of electromagnetic disturbance.

In some embodiments, the extraction device can comprise a line comprising an impedance component adapted to taper a voltage supplied by a source of electromagnetic disturbance or to a source of an electromagnetic disturbance. The impedance component can comprise resistive, inductive and/or capacitive portions.

Additionally or alternatively, the extraction device can comprise an antenna, which is exposed to the electromagnetic disturbance. This can induce a signal in the antenna by crosstalk. This signal can be used as a decoupled disturbance signal in the inventive method.

Additionally or alternatively, the extraction device can comprise a winding, which is inductively coupled with a transformer, transforming a signal of the source of electromagnetic disturbance.

As described above, it can be advantageous to use a plurality of extraction devices that are of the same or different kind depending on the number of sources of electromagnetic disturbance generating electromagnetic disturbance signals that interfere with the measured data signal.

In some embodiments, the conditioning module can comprise at least one phase shifter, and at least one amplification module.

In some embodiments, the conditioning module can be digitally controlled. Additionally or alternatively, software control is possible.

In some embodiments, the decoupled disturbance signal in a form of analogous signal can be conditioned by adjusting the phase and/or the amplitude of the decoupled disturbance signal to obtain the compensation signal. In the context of this description including the claims, the amplitude adjustment of the decoupled disturbance signal is mostly addressed as an amplitude amplification. In general, this is also the case, because the amplification factor is greater than one. However, also amplification factors below one, which result in an amplitude reduction, shall be encompassed by the term "amplitude amplification". Therefore, amplitude adjustment is just another term to describe the amplitude amplification used in the invention to condition the decoupled disturbance signal.

In some embodiments, the adding module can comprise a junction to which the adding module is adapted to supply both the measured data signal and the compensation signal in order to superpose them. There may also be a plurality of junctions, particularly in a case where a plurality of sources of electromagnetic disturbance, each generating an added crosstalk signal are present.

In a third aspect of the invention, a mass spectrometer comprising the signal-processing unit, according to previously described embodiments is disclosed.

In a fourth aspect of the invention, a mass analyser configured to trap ions by electrostatic electrodes, and comprising the signal processing unit according to previously described embodiments is disclosed.

In a fifth aspect of the invention, a Fourier transform mass spectrometer (FTMS) is disclosed. The FTMS comprises a detector unit adapted to detect a measured data signal. The FTMS also comprises a source of electromagnetic disturbance generating electromagnetic disturbance that interacts with the detector unit by crosstalk, resulting in the measured data signal comprising an added crosstalk signal. The FTMS further comprises an extraction device adapted to extract a decoupled disturbance signal from the source of electromagnetic disturbance. The FTMS also comprises a conditioning module adapted to condition the decoupled disturbance signal by applying a phase shift and/or an amplitude amplification to obtain a compensation signal, in particular a phase shift and an amplitude amplification to obtain a compensation signal. The FTMS further comprises an adding module adapted to superpose the measured data signal and the compensation signal. The compensation signal can be conditioned by the conditioning module in such a way, that it essentially corresponds to an inverted added crosstalk signal.

In some embodiments, the detector unit can be adapted to detect a measured data signal, which is generated by an image current.

In some embodiments, the adding module of the FTMS can further comprise a junction to which the adding module is adapted to supply both the measured data signal and the compensation signal in order to superpose them. As described above, multiple junctions can also be present.

In some embodiments, the FTMS further comprises a signal-processing unit according to any of the previously described embodiments.

In some embodiments, the FTMS can comprise a mass analyser that is trapping ions by electrostatic electrodes.

In a sixth aspect of the invention, use of the signal-processing unit is disclosed. The use is according to previously described embodiments of the signal processing units to filter added crosstalk signals induced by sources of electromagnetic disturbance from the measured data signal.

Below follows another description of the present disclosure, tailored specifically for us in Fourier transform mass spectrometry.

An electromagnetic disturbance is emitted by a source of an electromagnetic disturbance. A crosstalk can then be induced by this electromagnetic disturbance in the detector unit of a Fourier transform mass spectrometer. This crosstalk then modifies the measured data signal provided by the detector unit.

It was found that a source of an electromagnetic disturbance emits only a signal of one specific angular frequency, preferably a sinus wave. Therefore, the added cross talk signal of each source of an electromagnetic disturbance is only a signal of its specific angular frequency.

A decoupled disturbance signal can be extracted from the source of an electromagnetic disturbance by an extraction device. This extracted signal also has the same specific frequency and the same wave shape that the electromagnetic disturbance and the added cross talk signal. The decoupled disturbance signal and the added cross talk signal may differ in their amplitude and may have a phase shift between them. The amplitude of both signals differs, because there are different coupling processes to induce the cross talk into the signal measured by the detector unit and to extract the decoupled disturbance signal by an extraction device. Additionally, a phase shift may occur between signals due to the different coupling processes. Furthermore, it may take a different time for each signal to reach the adding module, which can also result in a phase shift between the signals.

The present document discloses a compensation signal, which is at least an essentially inverted signal of the added crosstalk signal, preferably the inverted signal of the added crosstalk signal, for each source of electromagnetic disturbance. Superposition of the compensation signal and the added crosstalk signal is resulting in destructive interference, because the signals are out of phase. In this way, the added crosstalk signal of the source of an electromagnetic disturbance can be at least essentially erased from the measured data signal. Then, the compensated data signal provided by the adding module is the same as an undisturbed measured data signal, which would be obtained in the absence of the electromagnetic disturbance, emitted by the source of an electromagnetic disturbance.

To obtain the compensation signal, which is at least an essentially inverted signal of the added crosstalk signal, the decoupled disturbance signal has to be conditioned by the conditioning module. The condition module adjusts the amplitude and the phase of the decoupled disturbance signal, so that the compensation mode has the at least essentially the same amplitude as the added cross talk signal and has a phase with a phase shift of at least essentially 180° compared to the added crosstalk signal. Therefore, the conditioning module has to modify the amplitude of the decoupled disturbance signal and to change the phase of the decoupled disturbance signal. Preferably, the conditioning module comprises at least one phase shifter and one amplitude amplifier.

To condition the decoupled disturbance signal by the amplitude amplifier and phase shifter in the right way to achieve a compensation signal, the amplitude amplifier and phase shifter have to be controlled in an appropriate way. To define the controlling parameters of the amplitude amplifier and the phase shifter special software can be used. The controlling parameters can be obtained by iterative variation during a measurement of a mass spectrum with the Fourier Transform (FT) mass spectrometer.

To define the angular frequencies in the mass spectrum that belong to an electromagnetic disturbance, measurements without ions can be done in a FT mass spectrometer. By observing the identified disturbance peaks in the mass spectrum it can be observed how a change of the controlling parameters of the amplitude amplifier and phase shifter changes the observed peak of the disturbance. The controlling parameters of the amplitude amplifier and phase shifter are preferably adapted several times one after the other, because a phase shift may influence the signal amplitude and vice versa. A controlling parameter is for example accepted and the disturbance peak erased, if its amplitude is less than two times higher than the noise signal of a measurement. A disturbance peak for example is erased if the remaining phase shift between the added cross talk signal and the compensation signal is below 1°. This calibration of the controlling parameters of the condition module is preferably executed during every calibration phase of a FT mass spectrometer.

A controlling parameter is typically accepted and the disturbance peak erased, if its amplitude is less than three times larger than the noise signal of a measurement, preferably less than two times larger than the noise signal of a measurement and particularly preferably less than 1.5 times larger than the noise signal of a measurement. Also, other ratios between the erased disturbance peak and the noise signal of a measurement can be used to define which controlling parameters are accepted. The choice of the accepted ratio might depend on the specific kind of the mass spectrometer, as well as on the investigated sample and experiment. Furthermore, the signal levels of erased peak and noise of the measurement can be identified by an integration procedure of the mass spectrum over a specific mass to charge window.

A disturbance peak typically is erased if the remaining phase shift between the added cross talk signal and the compensation signal is below 3°, preferably below 1° and in particular preferably below 0.5°. Also, other remaining phase shifts may be acceptable. The choice of the accepted phase shift might depend on the specific kind of investigated sample and experiment.

The system is very robust, because any change of the frequency, wave shape and intensity of the electromagnetic disturbance affects the added cross talk signal and the decoupled disturbance signal in the same way, and a change of the controlling parameters defined for a source of an electromagnetic disturbance is not required. For each source of an electromagnetic disturbance, a separate compensation circuit comprising an extraction device and a conditioning module with specific controlling parameters can be provided. Each compensation circuit is then erasing one disturbance peak.

BRIEF DESCRIPTION OF THE DRAWINGS

The drawings, described below, are for illustration purposes only. The drawings are not intended to limit the scope of the present teaching in any way.

DETAILED DESCRIPTION

In the following, exemplary embodiments of the invention will be described, referring to the figures. These examples are provided to provide further understanding of the invention, without limiting its scope.

In the following description, a series of features and/or steps are described. The skilled person will appreciate that unless required by the context, the order of features and steps is not critical for the resulting configuration and its effect. Further, it will be apparent to the skilled person that irrespective of the order of features and steps, the presence or absence of time delay between steps or simultaneous implementation, can be present in some or all of the described steps.

Figure 1:
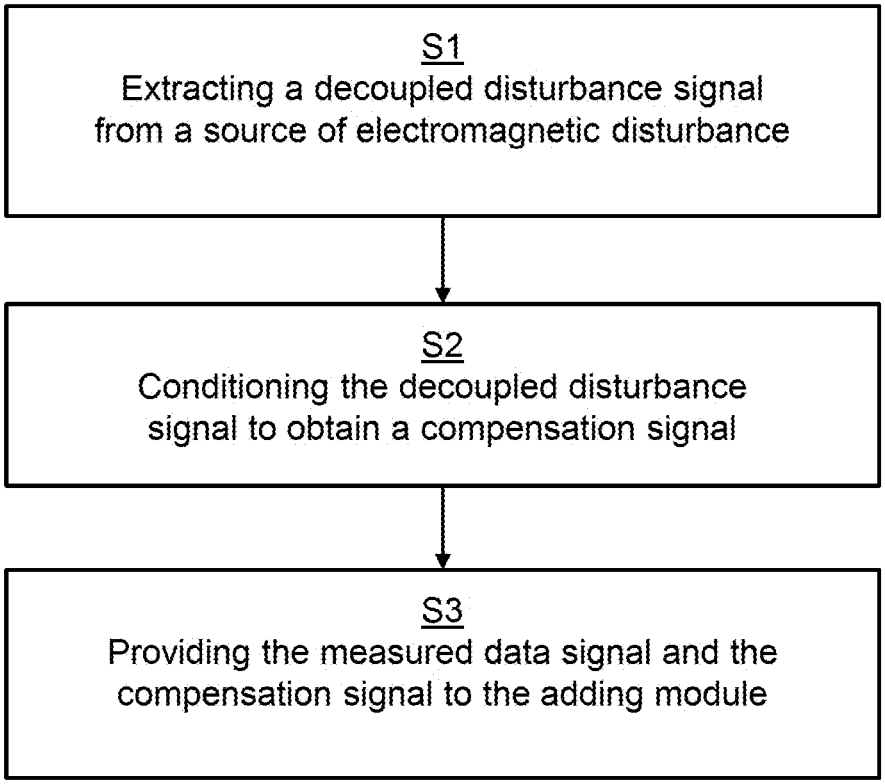
FIG. 1 exemplifies a block scheme presenting a method according to an embodiment of the invention.

FIG. 1 shows a block scheme schematically describing the steps of the inventive method. A description of the method follows with also reference to FIGS. 3A, 3B, 3C for the components that can be used to implement the method.

The method can be applied to a system comprising a detector unit 200 adapted to output a measured data signal 20, which is preferably by an image current. In particular, the method can be used with systems such as Fourier transform mass spectrometers, like ion cyclotron resonance mass spectrometers (ICR mass spectrometers, ICR-MS) and mass spectrometers using ion trapping, like Orbitrap® mass spectrometers offered by Thermo Fisher Scientific (Bremen) GmbH and Thermo Fisher Scientific Inc.

In systems comprising such detector units, sources of an electromagnetic disturbance 100 may be present. Such sources of an electromagnetic disturbance 100 can be electronic devices like quadrupole electrode, the RF voltage supply of quadrupole electrodes, vibrations of vacuum pumps and other supplied RF voltages, e.g. of ion optics, AC/DC converter. Such devices emit an electromagnetic disturbance signal 102 (also referred to as an added crosstalk signal 102), for example electromagnetic radiation, which can unintentionally interact with the detector unit 200. Such interaction is generally known as crosstalk of the electromagnetic disturbance signal 102 and the detector unit 200. The crosstalk is modifying the measured data signal 20 in comparison to an undisturbed measured signal (which would be hypothetically measured in the absence of this interaction). It was found that due to the crosstalk of the electromagnetic disturbance signal 102 with a detector unit 200, which is detecting a measured data signal 20 generated by an image current, an added crosstalk signal is superposed to the undisturbed measured signal. For many sources of an electromagnetic disturbance 100, the added crosstalk signal is a periodic signal, which is interfering with the undisturbed measured signal. In particular, due to such added cross talk signals, the following effects can occur in the measured data signal 20: additional harmonics, phase shifts, destructive interference, beats, and standing waves. The present method describes a way to compensate such undesirable added crosstalk signals in order to obtain a compensated data signal 22. The method can, for example, be used in the field of Fourier transform mass spectroscopy with the detector unit 200 being a part of the mass spectrometer. As a concrete example, the method can be used with an Orbitrap® mass analyser in order to filter out undesirable added crosstalk signals. Such added crosstalk signals can originate, for example, from quadrupole electrodes, generators supplying the RF voltage to quadrupole electrodes (such as electrodes of quadrupole mass filters) or from components of the detector unit 200 and/or electronics in the surrounding of the detector unit 200.

The method can comprise step S1 of extracting a decoupled disturbance signal 10. The decoupled disturbance signal 10 can originate from any source of electromagnetic disturbance 100, and can be extracted by an extraction device 103. The electromagnetic disturbance originated from such a source of electromagnetic disturbance can interact with the detector unit 200 by crosstalk. Due to this, an added crosstalk signal is added by superposition to an undisturbed measured data signal, which would be detected by the detector unit 200, if the source of disturbance 100 would be absent or not active. The interaction is resulting in the measured data signal 20 comprising the added crosstalk signal. Therefore, the crosstalk between the electromagnetic disturbance signal 102 emitted by the source of electromagnetic disturbance 100 and the detector unit 200 is influencing the measured data signal 20.

The effect of crosstalk can be eliminated by using the decoupled disturbance signal to adjust the measured data signal 20 in order to obtain a compensated data signal 22. The effect of crosstalk is then eliminated, when the influence of an added crosstalk signal on the compensated data signal 22 is so small, that it is irrelevant when supplied to a data-receiving device. This means that the remaining influence of an added crosstalk signal on the compensated data signal 22 is so small, that for information derived from the compensated signal supplied to the data receiving device, no other result was derived, then the one that would be derived from an undisturbed measured data signal. In other words, the added crosstalk signal is eliminated when information derived from the compensated signal 22 is not influenced by the presence of the source of an electromagnetic disturbance 100 and the associated crosstalk. For example, in a Fourier transform mass spectrometer, any identified mass peak caused by a source of an electromagnetic disturbance 100 and not by detected ions is eliminated. There might be specific criteria, which can be used to define when a mass peak is identified. Examples of such criteria are already described before. For example, the remaining influence of an added crosstalk signal might be small enough, if its amplitude is significantly reduced. The amplitude may be reduced so much, that it is below five times of the medium amplitude of a measured noise signal, preferably below three times of the medium amplitude of a measured noise signal and in particular below two times of the medium amplitude of a measured noise signal. On the other hand, the remaining influence of an added crosstalk signal might be small enough, if the phase shift between the added crosstalk signal and the compensation signal 16 deviates only very little from 180°, when both signals are supplied to the same junction in an adding module 220. Typically, the value of the deviation from 180° is below 2°, preferably below 1° and more preferably below 0.5°. The extracting of the decoupled disturbance signal 10 can be achieved by extraction device 103, which is adapted to receive the decoupled disturbance signal 10 from the source of electromagnetic disturbance 100. The added crosstalk signal 102 (also referred to as an electromagnetic disturbance signal 102) of a source of electromagnetic disturbance 100 and its corresponding decoupled disturbance signal 10 comprise at least nearly exactly the same shape, but might have a different amplitude and/or might be phase shifted with respect to each other. Usually, the added crosstalk signal 102 of a source of electromagnetic disturbance 100 and its corresponding decoupled disturbance signal 10 are periodic functions. Then they have the same period T, frequency f and angular frequency ω. Obtaining the compensated data signal 22 therefore can require adjusting the decoupled disturbance signal 10 by conditioning before using it to adjust the measured data signal 20.

Therefore, in step S2, the decoupled disturbance signal 10 can be conditioned to obtain an appropriate compensation signal 16. This is done by applying a phase shift and/or amplitude amplification to the decoupled disturbance signal 10 to match or approach the amplitude and/or phase of the inverted added crosstalk signal 102 of the measured data signal 20. This is explained in more detail with reference to FIGS. 3A, 3B, 3C.

In step S3, the measured data signal 20 and the compensation signal 16 are provided to an adding module 220. In the adding module 220, both signals, are superposed, e.g. by supplying to one junction. By superposition of both signals, a compensated data signal 22 is generated, which can be supplied to a data-receiving device. In this way, a compensated data signal 22 can be obtained.

The conditioning module has to condition the decoupled disturbance signal 10 to obtain an appropriate compensation signal 16 in such a way that, when the measured data signal 20 and compensation signal 16 are superposed, the compensation signal 16 corresponds to an essentially inverted signal of the added crosstalk signal. This condition is satisfied when the amplitudes and phase shift of both signals only deviate so much, that the added crosstalk signal does not have a relevant influence on the compensated data signal 22 when it is supplied to a data-receiving device. Details about the acceptable amplitude deviation and phase deviation are described before.

Preferably, the conditioning module has to condition the decoupled disturbance signal 10 to obtain an appropriate compensation signal 16 in such a way that, when the measured data signal 20 and compensation signal 16 are superposed, the compensation signal 16 corresponds to the inverted added crosstalk signal.

The method can be performed continuously while the detector unit 200 generates the measured data signal 20. The electromagnetic disturbance signal 102 emitted by a source of an electromagnetic disturbance 100 may depend on time, the temperature and other parameters like a frequency of the source of an electromagnetic disturbance 100. The inventive method works independently of the temperature and other parameters like a frequency of the source of an electromagnetic disturbance 100 or time, and is therefore a very robust method. This is due to the effects of various parameter changes affecting the added crosstalk signal and the decoupled disturbance signal in the same way. In this way, the measured data signal 20 can be adjusted in real time or almost in real time to obtain the compensated data signal 22.

Figure 2:
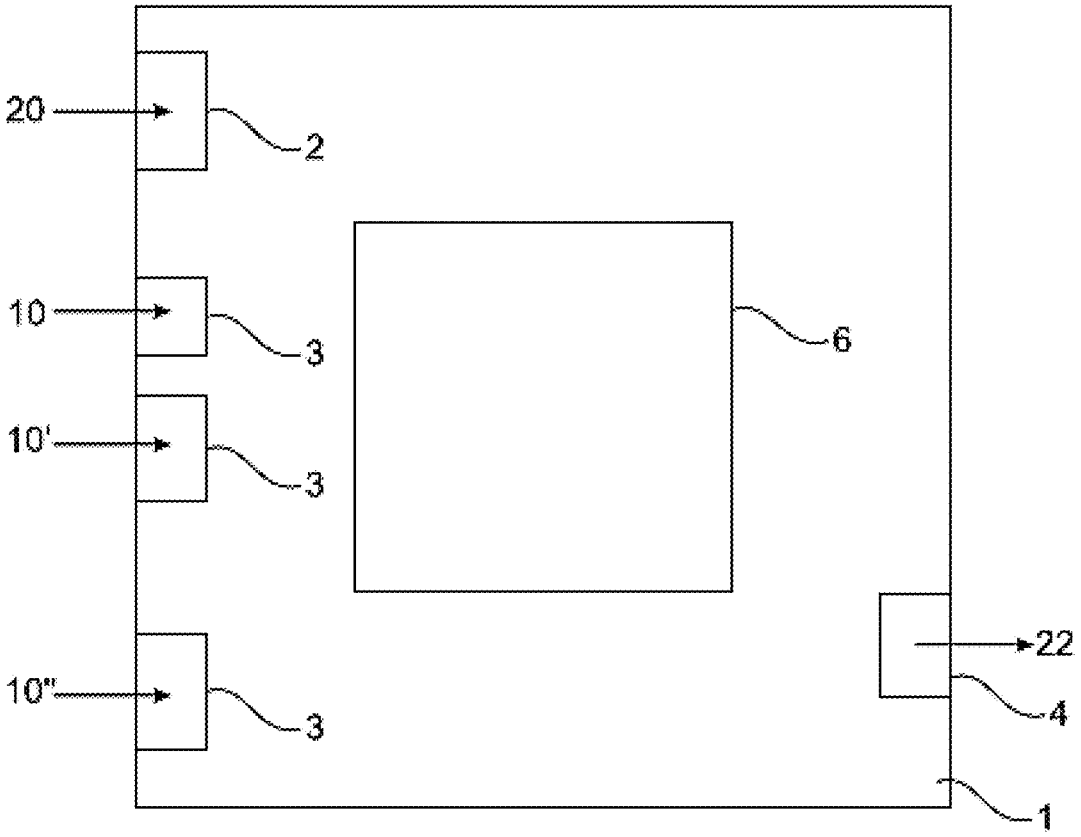
FIG. 2 exemplifies a schematic view of a signal processing unit according to an embodiment of the invention.

FIG. 2 shows a schematic example of a signal-processing unit 1 according to an embodiment of the invention. The signal-processing unit 1 can be adapted to physically compensate the added crosstalk signal induced by the electromagnetic disturbance comprised in the measured data signal 20 (not shown here).

The signal-processing unit 1 can comprise signal processing electronics 6, data signal input line 2, disturbance signal input line 3, and output line 4. The data signal input line 2 can be adapted to connect the device 1 to a detector unit 200 (not shown here) such as a Fourier transform mass analyser, said detector unit 200 producing a measured data signal 20. The disturbance signal input line 3 can be adapted to receive input from an extraction device (not shown here) that can respectively extract it from a source of electromagnetic disturbance 100. Such input is in the form of decoupled disturbance signal 10. FIG. 2 shows several disturbance signal input lines 3 receiving several different decoupled disturbance signals 10, 10', 10". This can be particularly advantageous in case several different sources of electromagnetic disturbance 100 are interfering with the measured data signal 20 via crosstalk. Using multiple disturbance signal input lines 3 allows for the multiple decoupled disturbance signals 10, 10', 10" to be obtained and then later the accordingly added crosstalk signals filtered out from the measured data signal 20 (not shown here). The decoupled disturbance signals 10, 10', 10" can be derived directly from the sources of the electromagnetic disturbance 100 via an extraction device 103. These extraction devices are discussed in more detail in relation to FIGS. 8A, 8B and 8C. The signal-processing device 1 can be adapted to receive the decoupled disturbance signals 10, 10', 10" originating from various sources of electromagnetic disturbance 100. The signal processing device 1 can be adapted to adjust said decoupled disturbance signals 10, 10', 10" so that they can be added to the measured data signal 20 to obtain a substantially crosstalk-free data signal, referred to as a compensated data signal 22. The output signal on the output line 4 can be adapted to connect the signal-processing device 1 to data reading devices, for example, an Analog-to-Digital converter. The compensated data signal 22 can then be transferred to data reading devices via the output line or lines 4. Thus, the signal-processing device 1 can be adapted to transfer a filtered data signal to a data-reading device via the output lines 4, allowing further visualization, processing and/or storing of the filtered signal, from which added crosstalk signals have been eliminated. Signal processing electronics 6 are discussed in more detail in relation to FIGS. 3A, 3B, 3C.

Figure 3A:
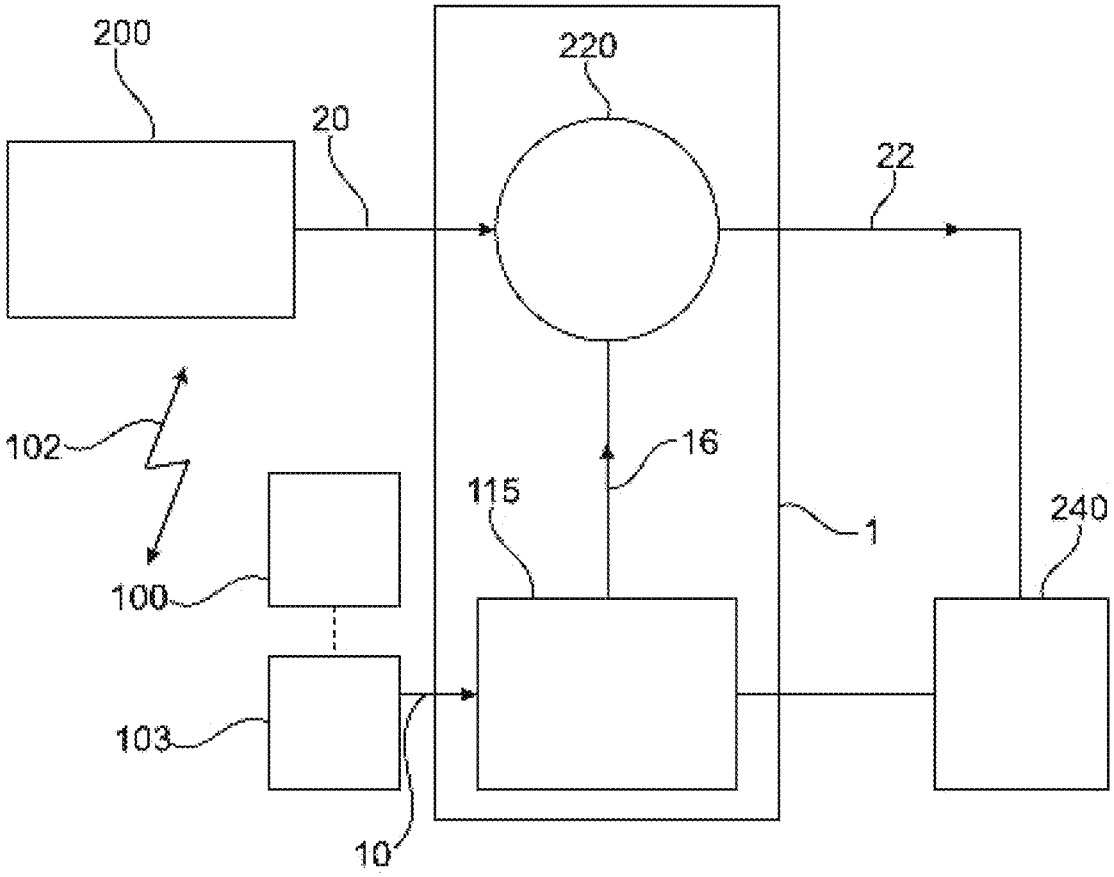
FIG. 3A shows a schematic view of an embodiment of an arrangement of signal processing components configured to execute the inventive method.

FIG. 3A shows a simplified schematic view of components configured to execute the inventive method according to the present disclosure. A detector unit 200 generates a measured data signal 20. Due to the interaction, e.g. be interference between the detector unit 200 and an electromagnetic disturbance signal 102 emitted by a source of electromagnetic disturbance, the measured data signal 20 includes an unwanted added crosstalk signal 102.

An extraction device 103 is configured to extract a decoupled disturbance signal 10 from the source of electromagnetic disturbance 102. This decoupled disturbance signal 10 comprises the same general shape and angular frequency as the added crosstalk signal 102, but may comprise a different amplitude and/or phase. The decoupled disturbance signal 10 is then input to a conditioning module 115, which is configured to adjust it to obtain a compensation signal 16. The compensation signal 16 is an input to an adding module 220, where the measured data signal 20 is also an input. The two signals are superposed, e.g. at one junction. The compensation signal 16 is conditioned in such a way, that it is an essentially inverted signal of the added crosstalk signal 102. Therefore, when the measured data signal 20 and the compensation signal 16 are superposed, the added crosstalk signal 102 is at least so far cancelled, that for information derived from the compensated signal 22 supplied to a data receiving device, no other result was derived, than the one that would be derived from an undisturbed measured data signal.

The compensated data signal 22 is then sent to a control unit 240. The control unit 240 is configured to receive the compensated data signal 22. In the case of Fourier transform mass spectrometry, the control unit 240 is further configured to display the mass spectrum after the applied Fourier transform. It can be further configured to control the conditioning module 115. Furthermore, the control unit 240 can control the calibration of the control parameters of the conditioning module. The control unit 240 can further trigger the calibration of the control parameters.

The signal-processing unit 1 consists of the adding module 220 and the conditioning module 115.

Figure 3B:
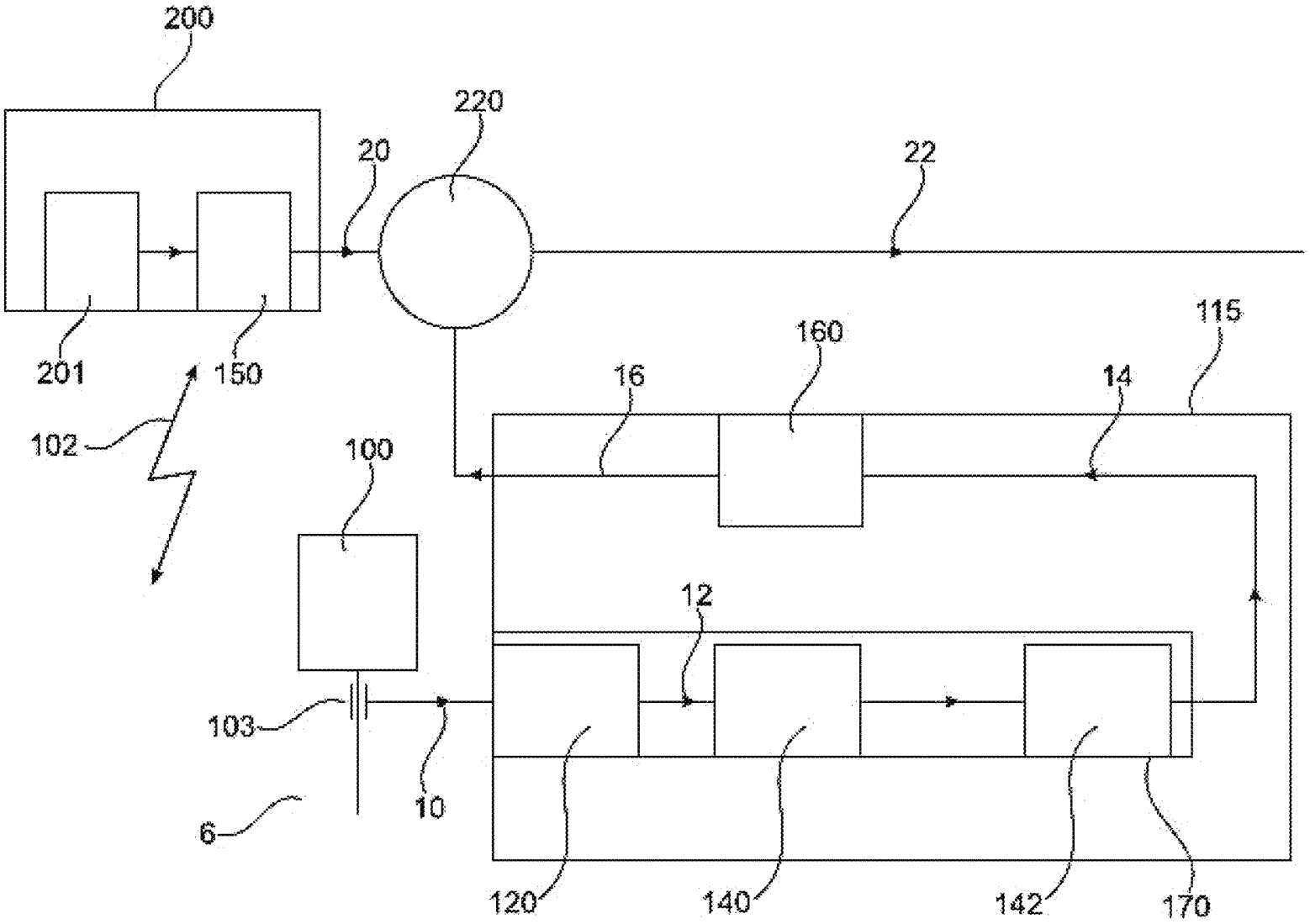
FIG. 3B shows a more detailed schematic view of an embodiment of an arrangement of signal processing components configured to execute the inventive method.

FIG. 3B shows a slightly more detailed schematic view of signal processing electronics 6 according to one embodiment of the invention. A source of electromagnetic disturbance 100 can interfere with a detector unit 200 outputting a measured data signal 20 via an electromagnetic disturbance signal 102. Put differently, the electromagnetic disturbance signal 102 originating from a source of electromagnetic disturbance 100 can undesirably interact with the measured data signal 20. The present device illustrates a device adapted to eliminate an added crosstalk signal induced by such electromagnetic disturbance signal 102 from the measured data signal 20 to obtain a compensated data signal 22.

A decoupled disturbance signal 10 can be obtained from a source of electromagnetic disturbance 100 by an extraction device 103. Possible ways of obtaining the decoupled disturbance signal 10 are discussed in relation to FIGS. 8A, 8B and 8C. The decoupled disturbance signal 10 undergoes a series of phase shifts via a phase shifter 170. The decoupled disturbance signal 10 can first travel to an inverter 120. The inverter 120 can be adapted to apply a substantially 180-degree phase shift to the decoupled disturbance signal 10 in order to "invert" it and yield an inverted decoupled disturbance signal 12. The inverted decoupled disturbance signal 12 can travel to a first phase shifter 140, followed by a second phase shifter 142. The first phase shifter 140 can be adapted to make coarse phase tuning of the inverted decoupled disturbance signal 12. The second phase shifter 142 can be adapted to make fine phase tuning of the inverted decoupled disturbance signal 12. The phase shifters 140, 142 can then output a modified decoupled disturbance signal 14. The phase shifters 120, 140, 142 can together form one 360°-phase shifter with fine adjustment steps. In different embodiments, the 360°-phase shifter can be made in the form of three phase shifters as shown or in the form of one or two, or any other amount of phase shifters without limiting the scope of the present invention. The inverter 120 and the phase shifters 140, 142 can be digitally controlled.

The modified decoupled disturbance signal 14 can then be guided to an amplifier 160. The amplifier 160 can be adapted to adjust the amplitude of the modified decoupled disturbance signal 14 to make it equal to the amplitude of added crosstalk signal incorporated into the measured data signal 20. This amplitude can be estimated, for example, based on the expected peak shape of the measured data signal 20 versus the obtained shape. Additionally or alternatively, the amplitude of the added crosstalk signal can be estimated based on calibration procedures performed without a sample. That is, a data acquisition session on a Fourier transform mass spectrometer can be run without an active sample the composition of which is to be determined. In this way, the obtained signal would comprise no data, but rather only the added crosstalk signal, which can then be measured and compensated for. The amplitude of the modified decoupled disturbance signal 14 can be changed in one or more steps or by iteratively observing the measured data signal 20 or signals derived from it. In particular, when a Fourier transform is applied to the measured data signal, the amplitude of peaks in a mass spectrum that are induced by the electromagnetic disturbance 102 can be observed. The amplifier 160 can then output a compensation signal 16. The amplifier 160 can be digitally controlled.

The phase shifter 170 comprising the inverter 120 and the phase shifters 140, 142, as well as the amplifier 160 are arranged in the conditioning module 115.

The compensation signal 16 can then be guided to an adding module 220. The adding module 220 can be adapted to superpose the compensation signal 16 to the measured data signal 20, which might be pre-amplified in order to subtract the added crosstalk signal from the measured data signal 20. The adding module 220 can output a compensated data signal 22.

The measured data signal 20 can have been pre-amplified by means of a pre-amplifier 150. The amplifier 150 can be adapted to be switched on or off in order to observe the measured data signal 20. It can be used when otherwise the measured data signal 20 would be low or when a user deems it convenient and/or necessary.

Figure 3C:
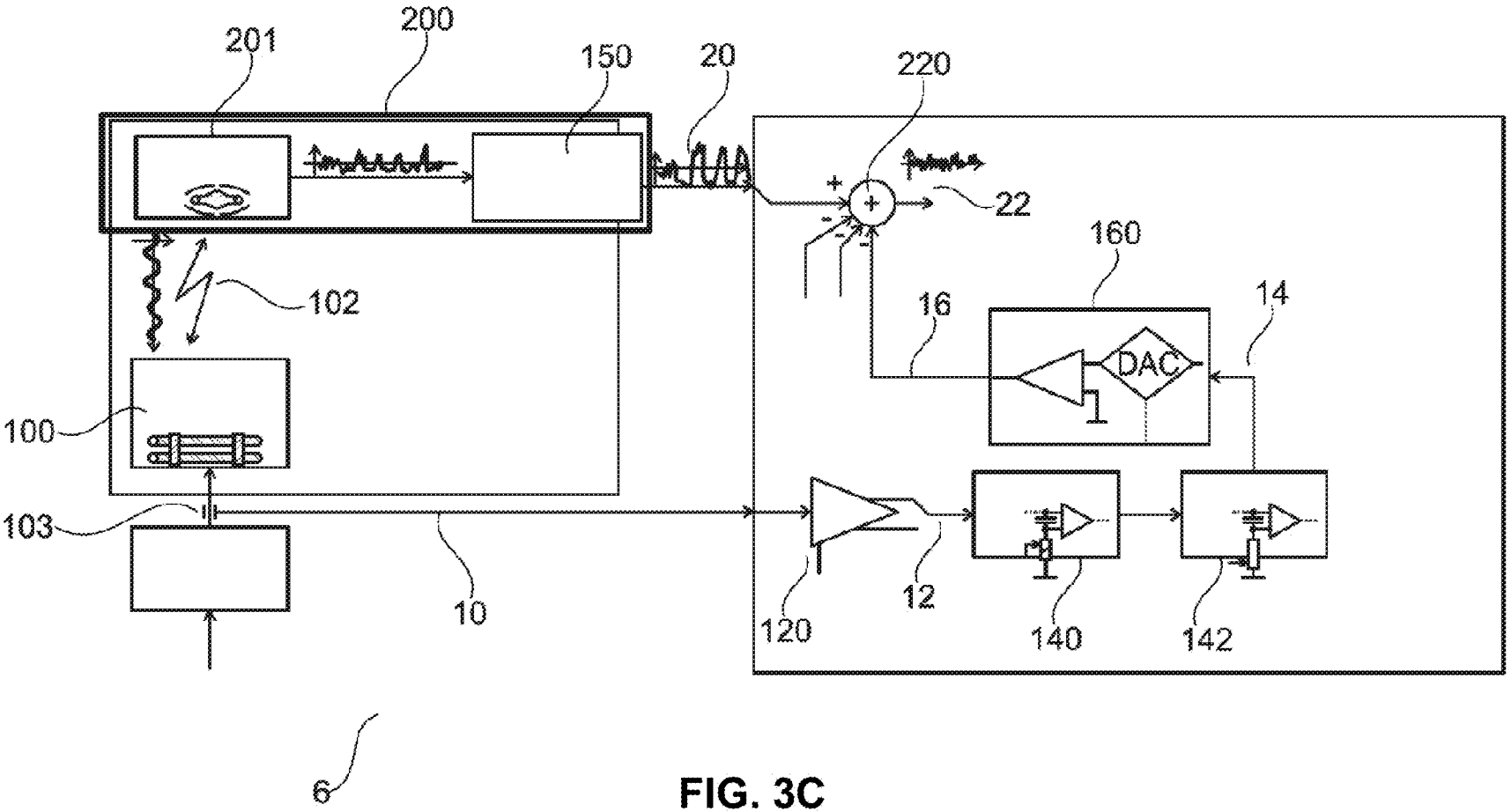
FIG. 3C shows a more detailed schematic view of an embodiment of an arrangement of signal processing components configured to execute the inventive method.

FIG. 3C shows a more detailed schematic view of signal processing electronics 6 according to one aspect of the invention where a source of electromagnetic disturbance 100 can be, for example, a quadrupole-RF-supply for a mass spectrometer. The mass spectrometer can comprise a detector unit 200. The detector unit 200 can comprise two outer electrodes 201 of an Orbitrap® mass analyser and a pre-amplifier 150. As discussed in relation to FIG. 3B, the detector unit 200 can output a measured data signal 20 that comprises an added crosstalk signal. The shape of electromagnetic disturbance signal 102 can be extracted from the source of electromagnetic disturbance 100 by a decoupled disturbance signal 10 via an extraction device 103. This signal can be adapted conditioned and superposed to the measured data signal 20 to modify the measured data signal 20 to obtain a substantially crosstalk-free data signal, a compensated data signal 22.

As described in relation to FIG. 3B, the decoupled disturbance signal 10 can travel to an inverter 120 resulting in an inverted decoupled disturbance signal 12. The inverted decoupled disturbance signal 12 can travel through first and second phase shifters 140, 142 to emerge as a modified decoupled disturbance signal 14. The modified decoupled disturbance signal 14 can travel through an amplifier 160 and come out as a compensation signal 16. This signal can then travel to a adding module 220 to be superposed to the measured data signal 20 The adding module 220 can output the compensated data signal 22.

In FIG. 3C, the complete signal acquisition path with crosstalk canceling components is demonstrated on the example of a quadrupole as a source of an electromagnetic disturbance 100. Source 100, electromagnetic disturbance signal 102, measured data signal 20, pre-amplifier 150, outer electrodes 201 of an Orbitrap® mass analyser are parts of a hitherto existing configuration typically used in Orbitrap® mass spectrometers. Extracting module 103, decoupled disturbance signal 10, inverter 120, inverted decoupled disturbance signal 12, first phase shifter 140, second phase shifter 142, modified decoupled disturbance signal 14, amplifier 160, compensation signal 16, and compensated data signal 22 are additional components, which perform the elimination of the added crosstalk signal 102 induced by the source of an electromagnetic disturbance 100.

The extraction module 103 is described in detail with reference to FIGS. 8A-8C. This device extracts the decoupled disturbance signal 10 from the source of the disturbance. This signal is provided to the conditioning module 115, which in this implementation comprises several stages of phase shifters 120, 140 and 142 shown in FIG. 4 and FIG. 5. The phase shifters assure the possibility to manipulate the phase in the full range of 0 . . . 360° in steps of sufficient resolution. Further, it comprises an amplifier 160 shown on FIG. 6 and an analogue adding module 220 shown on FIG. 7.

Figure 4A:
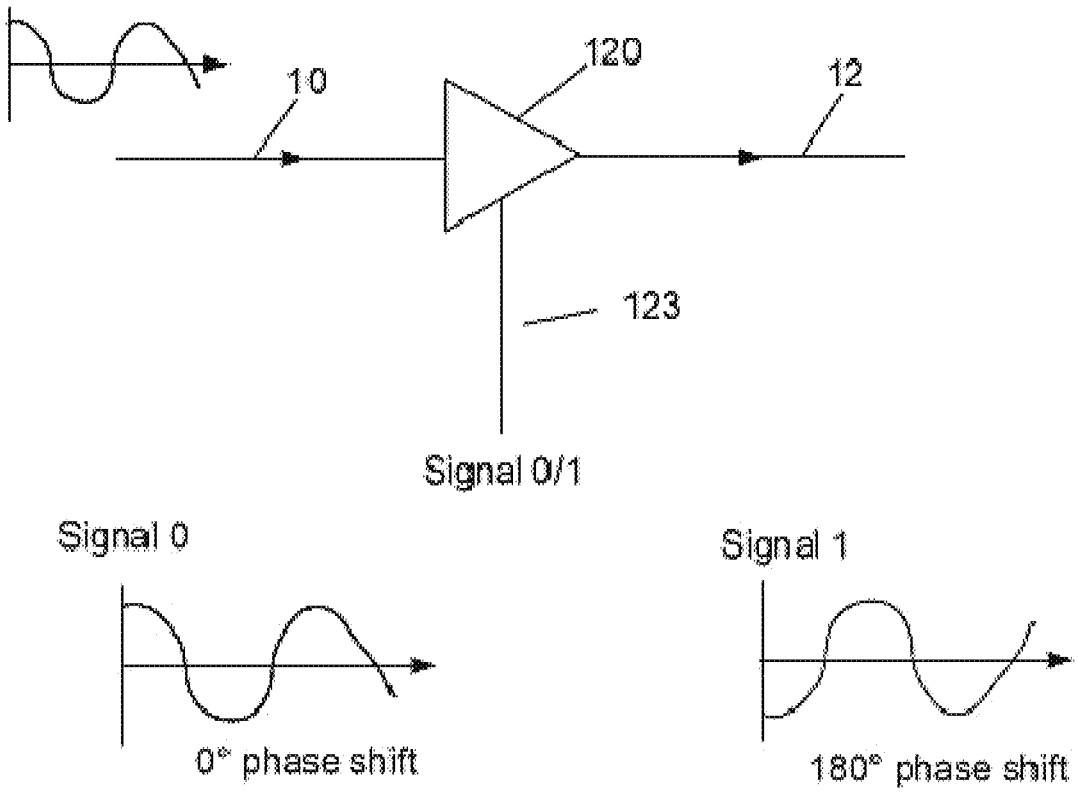
FIG. 4A shows a schematic view of an inverter, which can be used in an arrangement of signal processing components to execute to the inventive method, in particular in the arrangement of FIG. 3C.

FIG. 4A shows a simplified schematic illustration of the invertor 120 which can be digitally controlled. The decoupled disturbance signal 10 enters the invertor 120. Depending on the signal of the digital switch 123, the output can remain the same ("signal 0"), or be shifted by 180° ("signal 1"). This is illustrated in the figure by schematic signal representations. An inverted decoupled disturbance signal 12 can then, depending on the signal of the switch 123, exit the invertor 120.

Figure 4B:
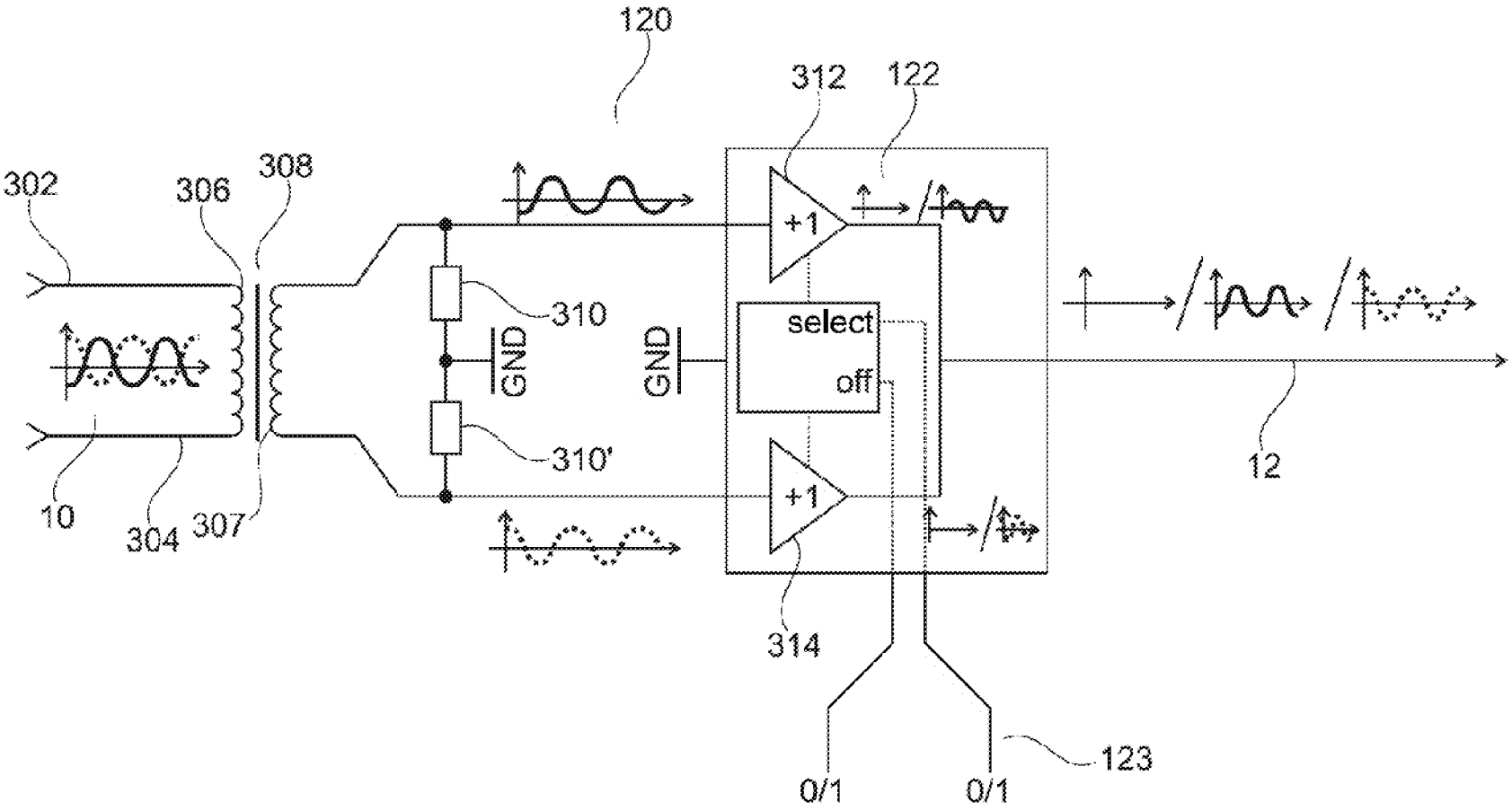
FIG. 4B shows a more detailed schematic view of the inverter of FIG. 4A.

FIG. 4B shows a schematic exemplary electrical circuit of the invertor 120 which can be digitally controlled and can be adapted to apply a phase shift of 0° or 180° to a decoupled disturbance signal 10. The invertor 120 can be adapted to apply a phase shift by means of inverter circuitry 122 and output an inverted decoupled disturbance signal 12.

In the used embodiment described in FIG. 4B, it is decided by a digital control switch 123 (signal 0/1), which shift is performed. The digital control switch activates one of two signal operational amplifiers 312 and 314, which are fed by each other with inverted signals derived from a transformer 308 having a primary electromagnetic coil 306 and a secondary magnetic coil 307. The decoupled disturbance signal 10 is applied at the (floating) primary electromagnetic coil 306, resulting in inverted voltage signals at the input points 302 and 304 in relation to a reference point in the middle of the primary electromagnetic coil 306. Then, two mutually inverted signals are applied by the transformer 308 at the ends of the secondary electromagnetic coil 307 due to the resistors 310 and 310' of the same resistance, which are both connected to the ground. Depending on the switch position, only one of the mutually inverted signals is provided as the intermediate inverted decoupled disturbance signal 12, which corresponds to the decoupled disturbance signal 10 with phase shift 0° or 180°.

A second digital signal switch is provided (signal 0/1) to switch off both operational amplifiers 312 and 314 for deactivating the whole conditioning module ("signal 1").

Figure 5:
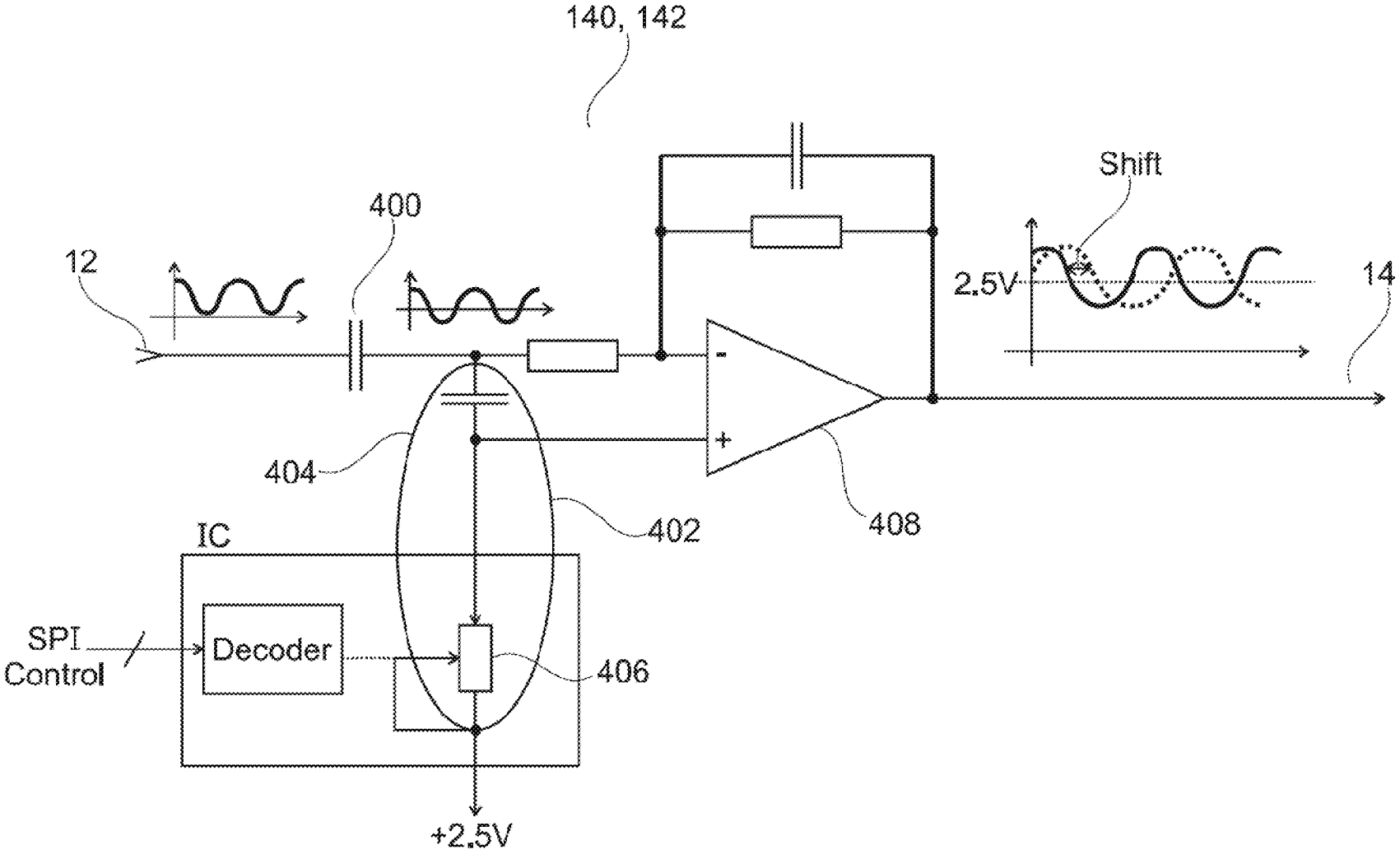
FIG. 5 shows a schematic view of a phase shifter, which can be used in an arrangement of signal processing components to execute to the inventive method, in particular in the arrangement of FIG. 3C.

FIG. 5 shows a schematic exemplary electrical circuit of the phase shifters 140, 142, which are connected sequentially. A first phase shifter 140, which can be digitally controlled, can be adapted to make coarse phase tuning of an inverted decoupled disturbance signal 12. A second phase shifter 142, which can similarly be digitally controlled, can be adapted to make fine phase tuning of the inverted decoupled disturbance signal 12. They can produce a modified decoupled disturbance signal 14.

Capacitors 404 on the positive input pin of the operational amplifier are selected so that the first shifter 140 can perform a rough shift of 0° . . . 160° in 128 steps (digital 7-bit access), while the second phase shifter 142 can perform a finer resolved shift of 0° . . . 40° in the same number of steps.

At first, the AC signal of the intermediate signal 12 is filtered by only a capacitor 400. The capacitor 400 is necessary when the intermediate signal is on a basic (DC) level, different from the ground level. Such constant signal might be superposed to the decoupled disturbance signal 10 having no influence on the eliminating of the added crosstalk signal.

The phase shift is defined by RC-element 402 with a capacitor 404 and a resistor 406 on the positive input of operational amplifier 408. The resistive part of the RC-element 402 is a digitally controlled resistor 406 (7 bit access), a potentiometer, so that the phase shift can be controlled digitally. Due to the topology of this shifter, the phase shift also affects the amplitude of the signal, which must be accounted for by the next stage 160 shown in FIG. 6. Due to the connection of the resistor 406 to a reference point of a 2.5 V, the output signal of the operational amplifier 408 has an accordingly medium level of 2.5 V.

Figure 6:
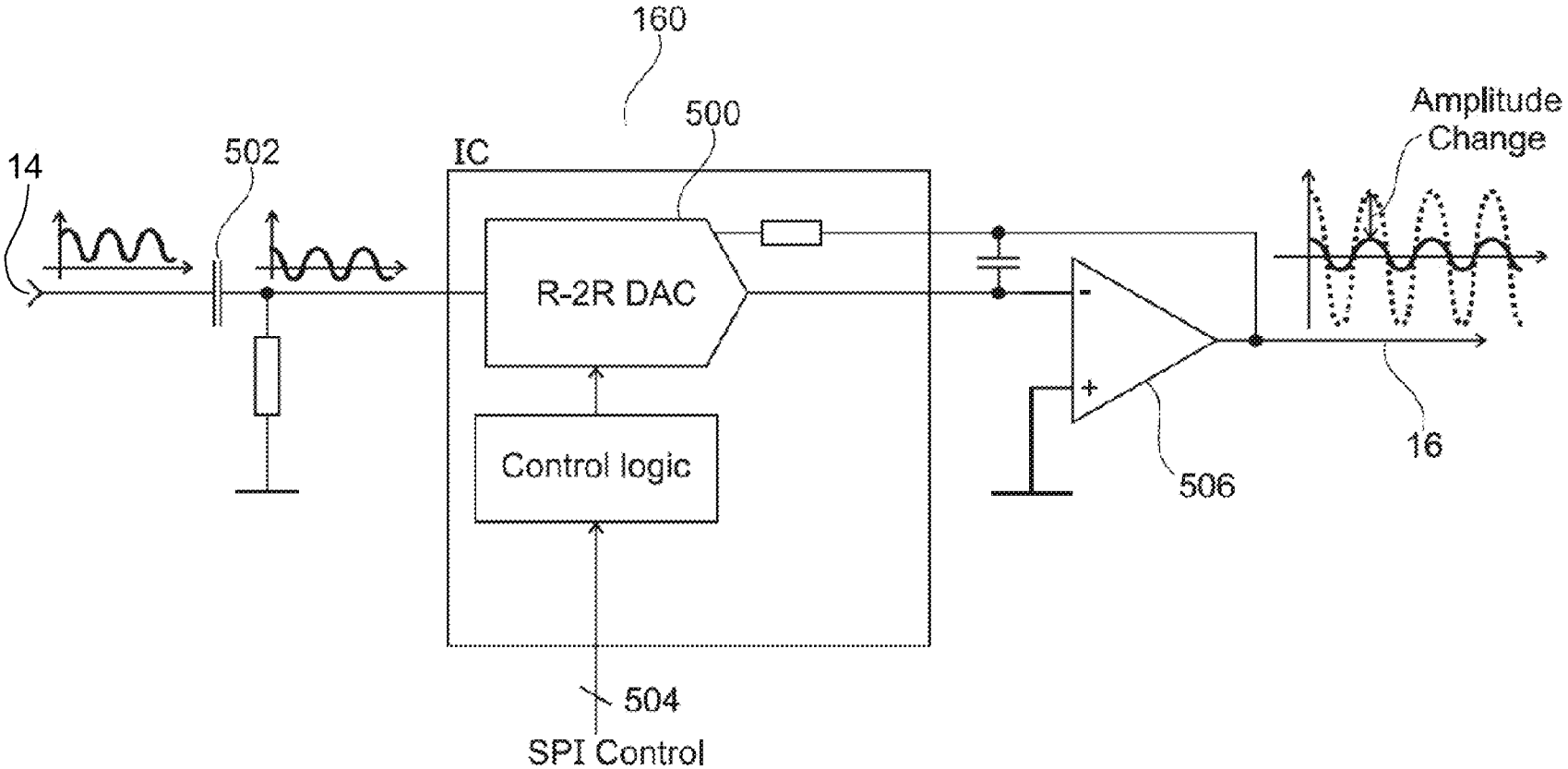
FIG. 6 shows a schematic view of an amplifier, which can be used in an arrangement of signal processing components to execute to the inventive method, in particular in the arrangement of FIG. 3C.

FIG. 6 shows an exemplary electrical circuit of an amplifier 160, which can be digitally controlled, and can be adapted to adjust the amplitude of a modified decoupled disturbance signal 14 to make it equal to the amplitude of added crosstalk signal incorporated into the measured data signal 20. The amplifier 160 can output a compensation signal 16.

The amplification is performed by a multiplying digital to analog converter 500, where the reference input is the modified decoupled disturbance signal 14.

Upstream of the digital to analog converter (DAC) 500, a capacitor is provided to filter only the AC signal of the modified decoupled disturbance signal 14 filtering the medium level of the signal of 2.5 V.

Different multiplying DACs with different resolution (8 . . . 24 bit access 504) are available. Via this access 504, the amplification provided by digital to analog converter 500 can be controlled. The output signal of the digital to analog converter 500 is then provided to an operational controller 506. The signals accordingly originating from phase shifters and the amplifier device are shown in FIG. 6.

The amplification accounts for the amplitude differences due to different ways of obtaining the added crosstalk signal and the compensation signal as well as for the amplitude loss in the phase shifter stages.

Figure 7:
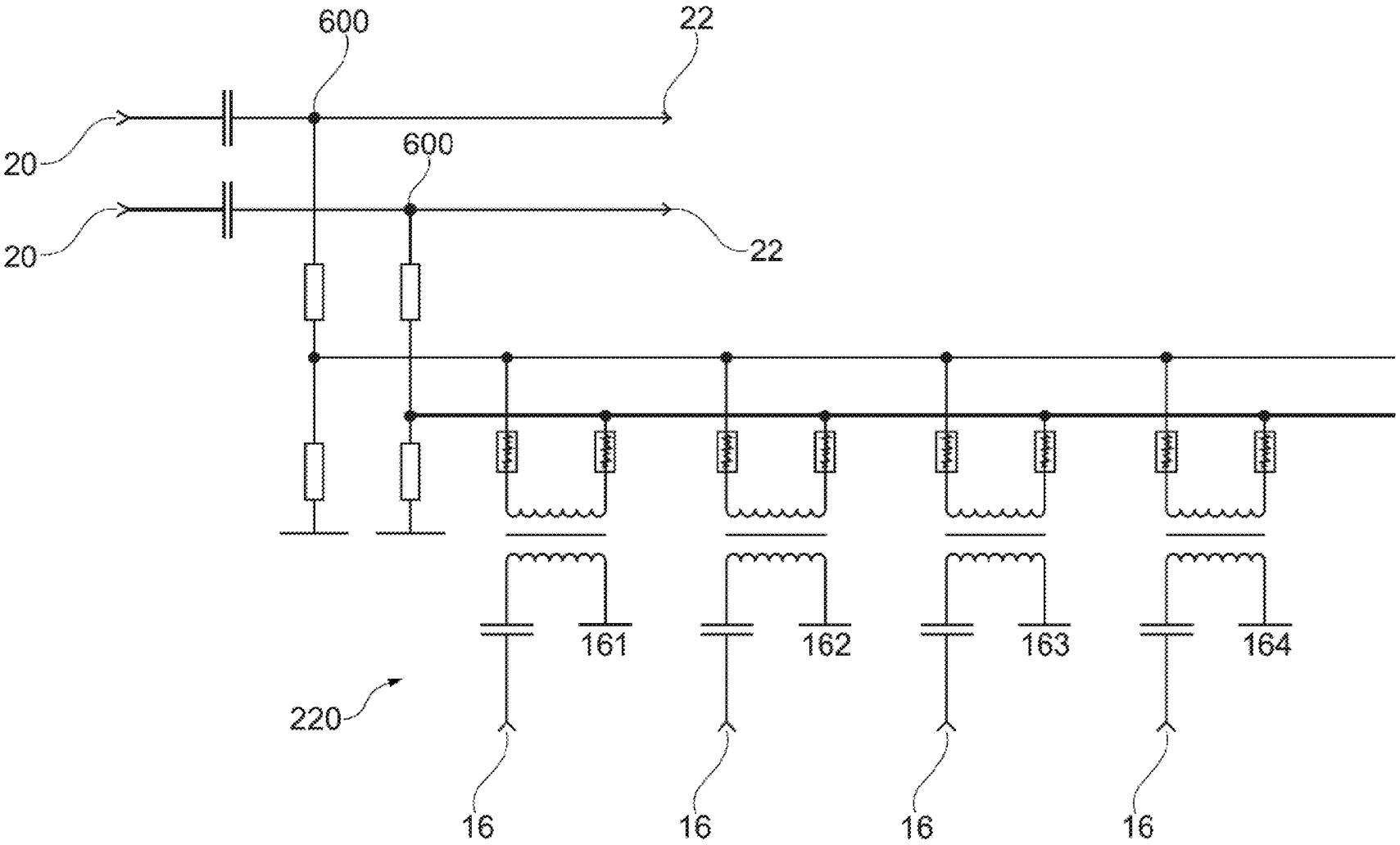
FIG. 7 shows a schematic embodiment of a adding module, which can be used in an arrangement of signal processing components to execute the inventive method, in particular in the arrangement of FIG. 3C.

FIG. 7 shows an exemplary electrical circuitry of an adding module 220. It can be adapted to superpose a compensation signal 16 to a measured data signal 20 and it can produce a compensated data signal 22.

If several crosstalk signals are being compensated, they can be added in the same way. The shown topology accounts for four compensation signals 161, 162, 163 and 164 of four different sources of an electromagnetic disturbance, which are at first added up and then provided as one signal to junction 600, to which also the measured data signal 20 is supplied. From the junction 600, the compensated signal 22 is provided to a data-receiving device. In this way, the added crosstalk signals of all four different sources of an electromagnetic disturbance are eliminated.

Figure 8A:
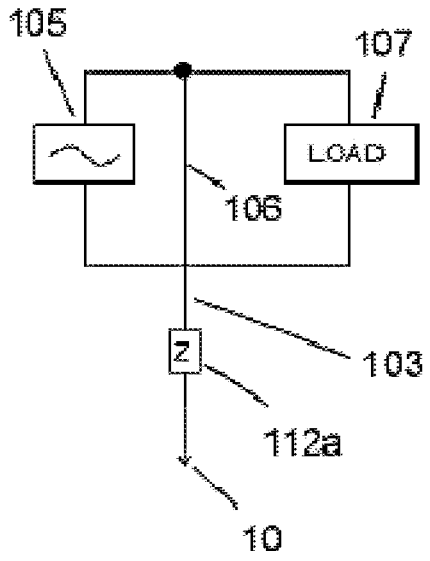
FIG. 8A shows an embodiment of an extraction device, adapted to extract a decoupled disturbance signal from a source of electromagnetic disturbance.

FIG. 8A shows an embodiment of an extraction device 103 adapted to extract a decoupled disturbance signal 10 from a source of electromagnetic disturbance 100. In the figure, a RF generator 105 is shown which supplies an RF voltage to a load 107 via an electrical circuit. Typically, the load 107 can comprise the electrodes of a quadrupole element in a Fourier transform mass spectrometer, like a quadrupole mass analyser or a quadrupole filter. The RF generator 105 or the load 107, e.g. the electrodes of the quadrupole supplied with the RF voltage may be a source of the electromagnetic disturbance 102. In addition, the RF current in the electrical circuit to supply the voltage to the electrodes can be the source of an electromagnetic disturbance 102. The electromagnetic disturbance 102 is interfering with a measured data signal 20 (not shown here). The extracting device 103 is an additional line 106, which is connected with the circuit supplying the RF voltage and which comprises an impedance component 112*a*. The extraction device 103 is for example tapping the voltage existing in the electrical circuit supplying the RF voltage to the load 107 at the junction of its additional line 106 with the circuit. The decoupled disturbance signal 10 is then available at the other end of the additional line 106. The impedance component 112*a* of the additional line 106 can comprise a resistive, an inductive, and/or a capacitive portion. The exact values of the impedance component 112*a* can depend on the frequencies of the generator 105.

Figure 8B:
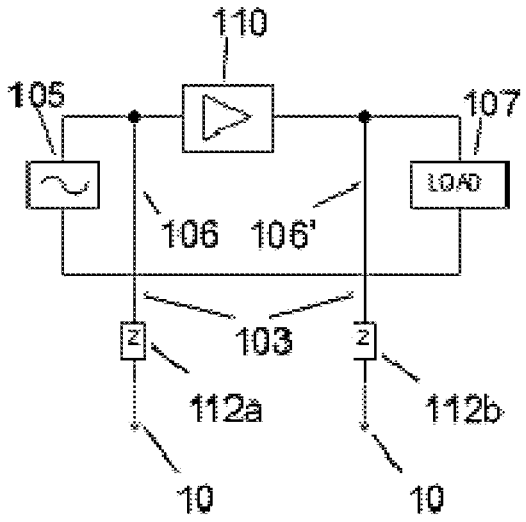
FIG. 8B shows another embodiment of an extraction device, adapted to extract a decoupled disturbance signal from a source of electromagnetic disturbance.

FIG. 8B shows two other embodiments of an extraction device 103 adapted to extract a decoupled disturbance signal 10 from a source of electromagnetic disturbance 100. In the FIG. 8B, a RF generator 105 is also shown, which supplies a RF voltage to a load 107 via an electrical circuit. Typically, the load can comprise the electrodes of a quadrupole element in a Fourier transform mass spectrometer, like a quadrupole mass analyser or a quadrupole filter. Furthermore, the electrical circuit comprises a voltage amplifier 100, which is amplifying the RF voltage provided by the RF generator 105. The RF generator 105 or the load 107, e.g. the electrodes of the quadrupole supplied with the RF voltage may be a source of the electromagnetic disturbance 102. In addition, the RF current in the electrical circuit to supply the voltage to the electrodes can be the source of an electromagnetic disturbance 102. The electromagnetic disturbance 102 is interfering with a measured data signal 20 (not shown here). The extracting device 103 is then an additional line 106, 106', which is connected with the circuit supplying the RF voltage and which comprises impedance components 112*a*, 112*b*. The extraction device 103 is for example tapping the voltage existing in the electrical circuit supplying the RF voltage to the load 107 at the junction of its additional lines 106, 106' with the circuit. For the additional line 106, the junction is arranged between the RF generator and the voltage amplifier 100. For the additional line 106', the junction is arranged between the voltage amplifier 100 and the load 107, e.g. the quadrupole electrodes. The decoupled disturbance signal 10 is then available at the other end of the additional lines 106, 106'. The amplitude of the decoupled disturbance signal is different depending on whether the voltage supplied by the RF generator has been amplified before it is tapped by the extraction device 103 or not amplified. The impedance component 112*a*, 112*b* of the additional lines 106, 106' can comprise a resistive, an inductive, and/or a capacitive portion. The exact values of the impedance component 112*a*, 112*b* can depend on the frequencies of the generator 105.

Figure 8C:
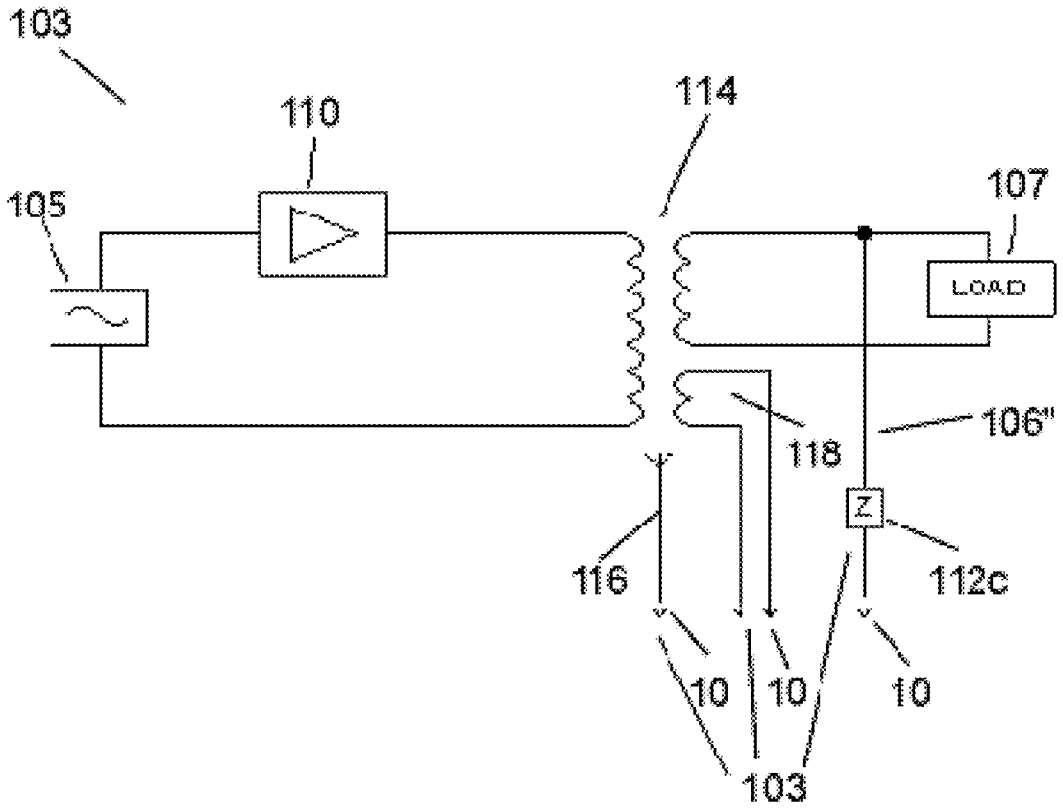
FIG. 8C shows further embodiments of extraction devices, adapted to extract a decoupled disturbance signal from a source of electromagnetic disturbance.

FIG. 8C shows further embodiments of extraction devices 103 adapted to extract a decoupled disturbance signal 10 from a source of electromagnetic disturbance 100. In the FIG. 8C, a RF generator 105 is shown, which supplies a load 107 with an RF voltage via a transformer 114. Generally, there is an inductive coupling of the RF generator with the load 107. Typically, the load 107 can comprise the electrodes of a quadrupole element in a Fourier transform mass spectrometer, like a quadrupole mass analyser or a quadrupole filter. Furthermore, the electrical circuit connecting the primary winding of the transformer 114 with the RF generator 105 may comprise a voltage amplifier 100, which can amplify the RF voltage provided by the RF generator 105. The RF generator 105 or the load 107, e.g. the electrodes of the quadrupole supplied with the RF voltage may be a source of the electromagnetic disturbance 102. In addition, the RF current in the electrical circuit to supply the voltage to the primary winding of the transformer 114 or the RF voltage applied at the primary winding of the transformer 114 can be the source of electromagnetic disturbance 102. The electromagnetic disturbance 102 is interfering with a measured data signal 20 (not shown here). The extracting device 103 can then be an additional line 106" comprising an impedance component 112*c* which is connected with the electrical circuit supplying the RF voltage from the secondary winding of the transformer 114 to the load 107. The extraction device 103 is able, for example, to tap the voltage existing in the electrical circuit supplying the RF voltage from the secondary winding of the transformer 114 to the load 107 at the junction of the additional line 106" with the circuit. The decoupled disturbance signal 10 is then available at the other end of the additional line 106". The impedance component 112*c* of the additional line 106" can comprise a resistive, an inductive, and/or a capacitive portion. The exact values of the impedance component 112*c* can depend on the frequencies of the generator 105. Another embodiment of an extraction device 103 is an antenna 116, which is exposed to the electromagnetic disturbance signal 102. The electromagnetic disturbance signal 102 is inducing a signal in the antenna 116 by crosstalk, which is a decoupled disturbance signal 10 that can be used in the invention. Another embodiment of an extraction device 103 is an additional winding 118, which is inductively coupled with the primary winding of the transformer 114. Then, voltage is induced in additional winding 118, which is then the decoupled disturbance signal 10, which can be used in the invention. The extraction device 103 can output the decoupled disturbance signal 10.

Independently of the configuration or of the schematic position of the extraction device 103, the decoupled disturbance signal 10 follows electromagnetic disturbance signal 102 in form, frequency, and amplitude. Both signals have the same form and frequency. Any change of the form and frequency of the electromagnetic disturbance signal 102 results in the same change of the form and frequency of the decoupled disturbance signal 10. Any relative change of the amplitude of the electromagnetic disturbance signal 102 will result in the same relative change of the amplitude of the decoupled disturbance signal 10. This means that if the amplitude of the electromagnetic disturbance signal 102 changes by an amplification factor Af, wherein Af is the ratio of the amplitude after the change to the amplitude before the change, the amplitude of the decoupled disturbance signal 10 changes also by same amplification factor Af.

Figure 9A:
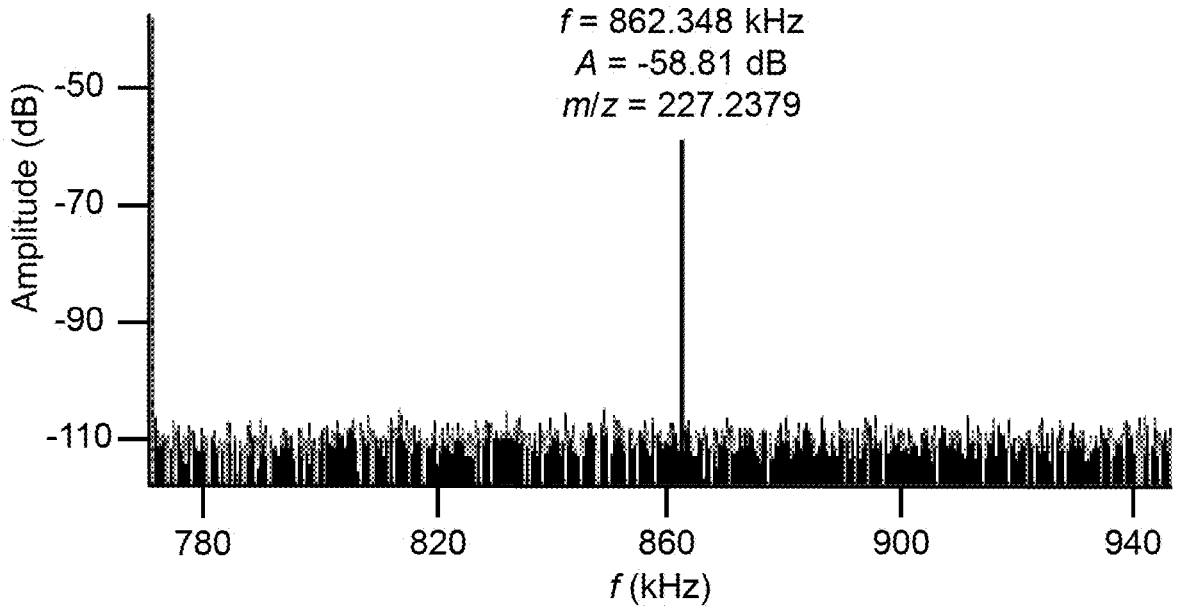
FIGS. 9A-9F depict exemplary embodiments of the data signal obtained before and after using the present method of crosstalk signal elimination.
Figure 9B:
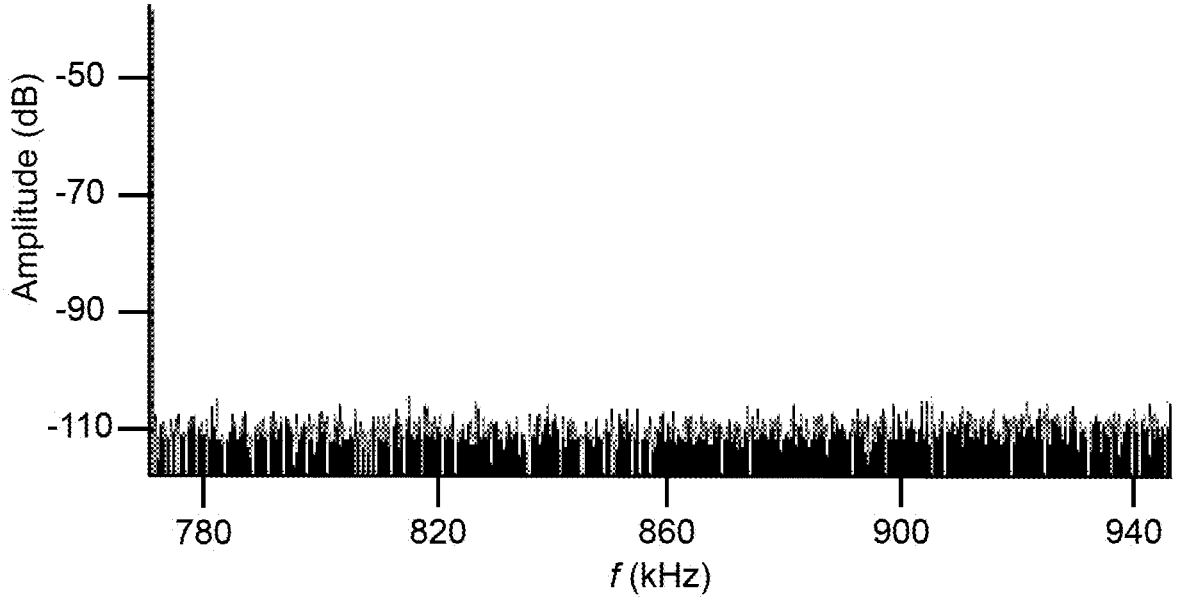

FIGS. 9A and 9B depict an exemplary embodiment of mass spectrum, which is the Fourier transform of measured data signal 20, obtained without using the present method of crosstalk signal elimination and with using it, measured by an Orbitrap® mass analyser.

FIG. 9A shows an exemplary signal including a large peak attributed to an electromagnetic disturbance, which is the induced added crosstalk signal. The added crosstalk has frequency of 862.348 kHz, which is adequate to a peak in the mass spectrum of the mass to charge ratio m/z=227.2379.

FIG. 9B depicts a mass spectrum, which is the Fourier transform of an exemplary compensated data signal 22 with no large peak due to the added crosstalk signal eliminated by adding the compensating signal 16 to the measured data signal 20. It can be seen that the noise signal (seen around 860 kHz) has been dramatically reduced, so that it cannot not been observed in the noise of the measurement.

FIGS. 9C, 9D, 9E and 9F depict another exemplary embodiment of mass spectrum of a signal measured by an Orbitrap® mass analyser.

Figure 9C:
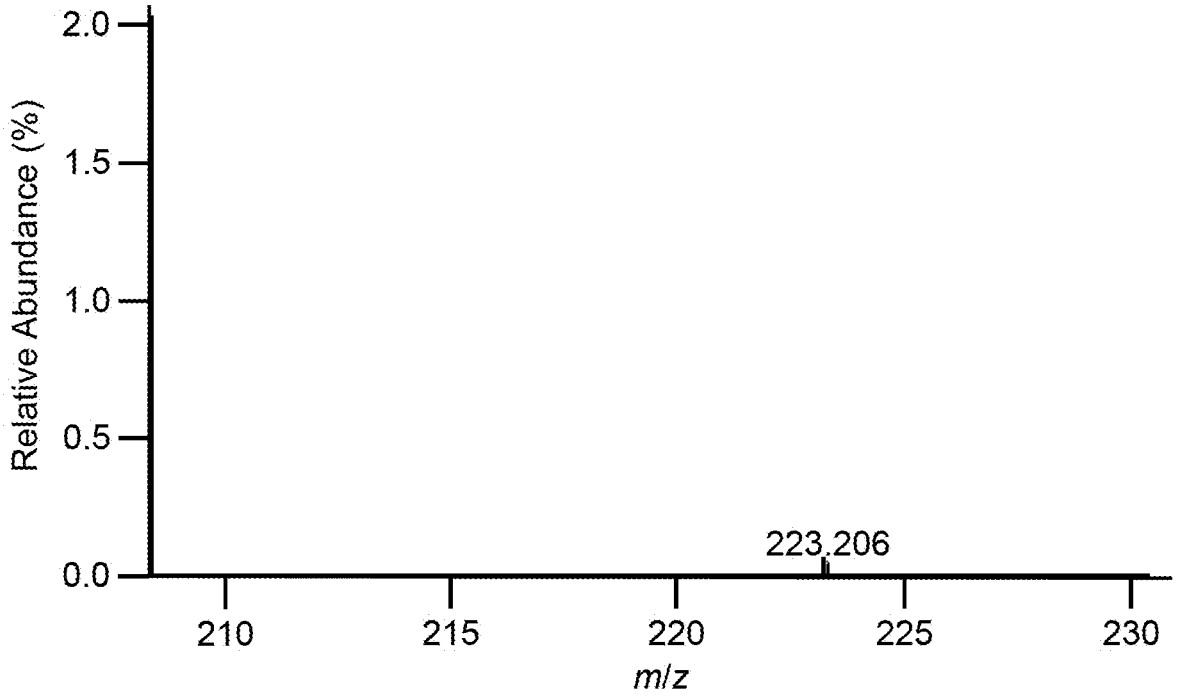
Figure 9D:
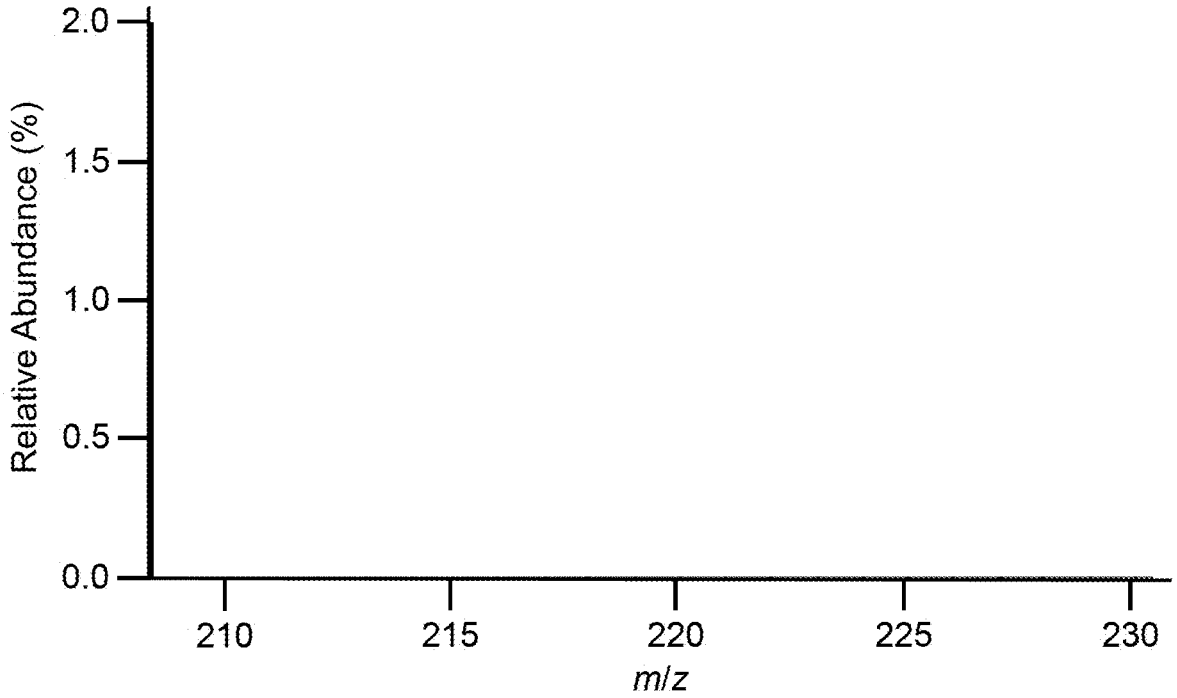

FIGS. 9C and 9D depict the measured data signal 20 in the absence of a sample being measured. In other words, no sample ions are present in the detector for the depicted measurement. FIG. 9C depicts a single peak at 223.206 mass to charge (m/z) ratio. This peak is due to the added crosstalk signal. In FIG. 9D, the same signal is depicted, with the added crosstalk signal compensated by the compensation signal 16.

Figure 9E:
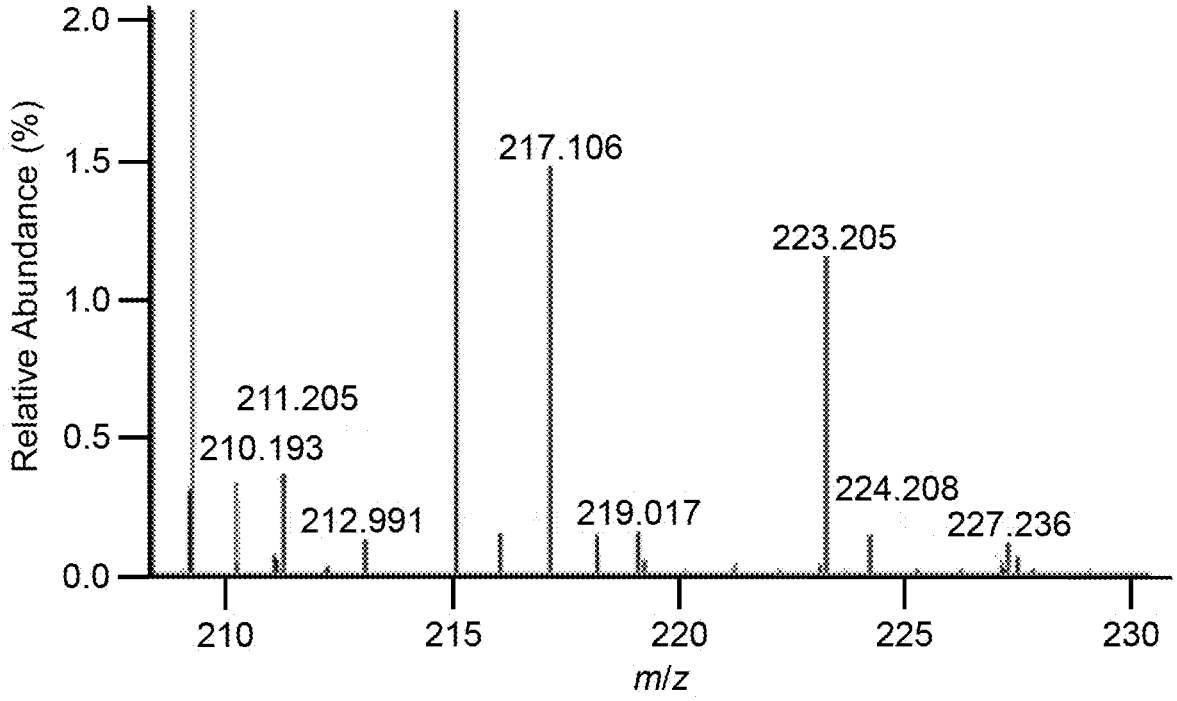
Figure 9F:
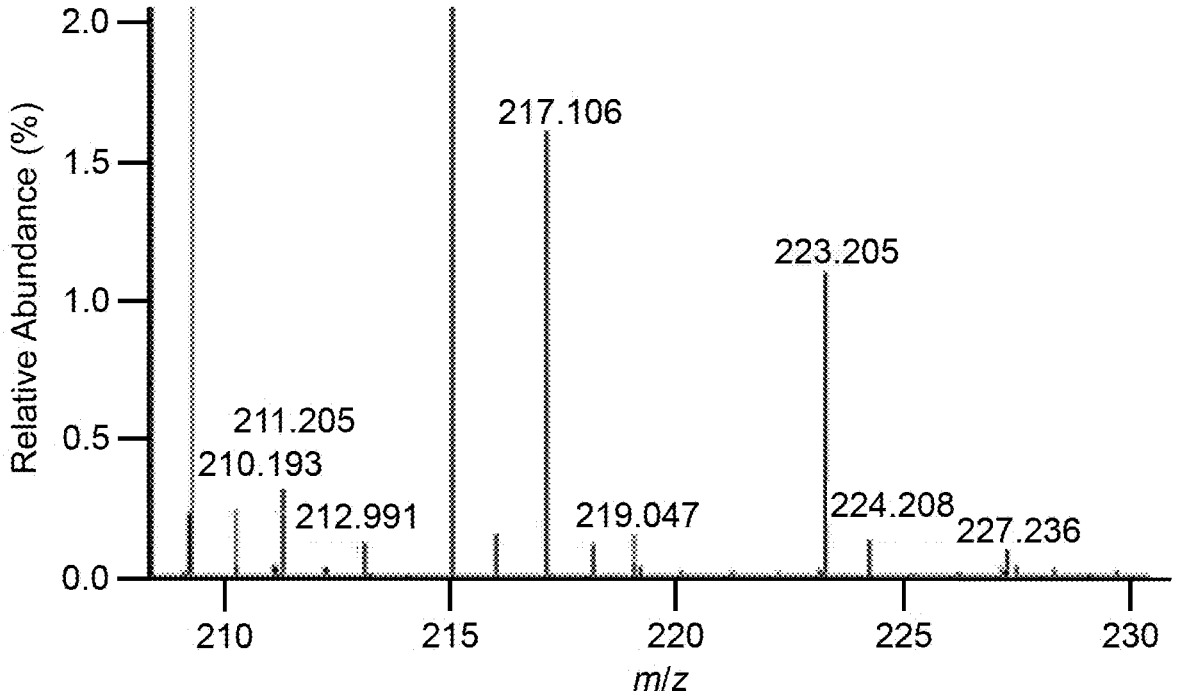

FIGS. 9E and 9F depict the measured data signal 20 for an exemplary sample comprising inorganic salts (Sodium iodide (NaI): 130 mM, Potassium iodide (KI): 5 mM, and Cesium iodide (CsI): 2 mM). FIG. 9E shows the measured data signal 20 including the added crosstalk signal. Note, that the data peak at 223.205 mass to charge ratio is at about 1.2 relative abundance. FIG. 9F shows the compensated data signal 22 with the added crosstalk signal superposed with the compensation signal 16 in order to substantially eliminate it. The data peak at 223.205 mass to charge ratio is now at about 1.1 relative abundance, which corresponds to the actual value due to the image current induced by the respective ions.

FIGS. 10A, 10B, 10C, and 10D depict an exemplary embodiment of calibrating control parameters of the conditioning module 115 for eliminating the added crosstalk signal.

The exemplarily described here conditioning module 115 comprises the inverter 120, the phase shifters 140 and 142 and the amplitude amplifier 160. These components are digitally controlled and are preferably calibrated at least once for a given disturbance source. These parameters build a four-dimensional search space with for example 2×128×128×1024 variations. A brute force procedure would need too much time to determine an optimal parameter set. The following describes an exemplary schematic calibration procedure that can be used for the determination of the parameter set to eliminate the added crosstalk signal induced by an electromagnetic disturbance 102 of a specific source of an electromagnetic disturbance 100.

The calibration procedure can be applied to a Fourier transform mass spectrometer, e.g. with an Orbitrap® mass analyser.

Figure 10A:
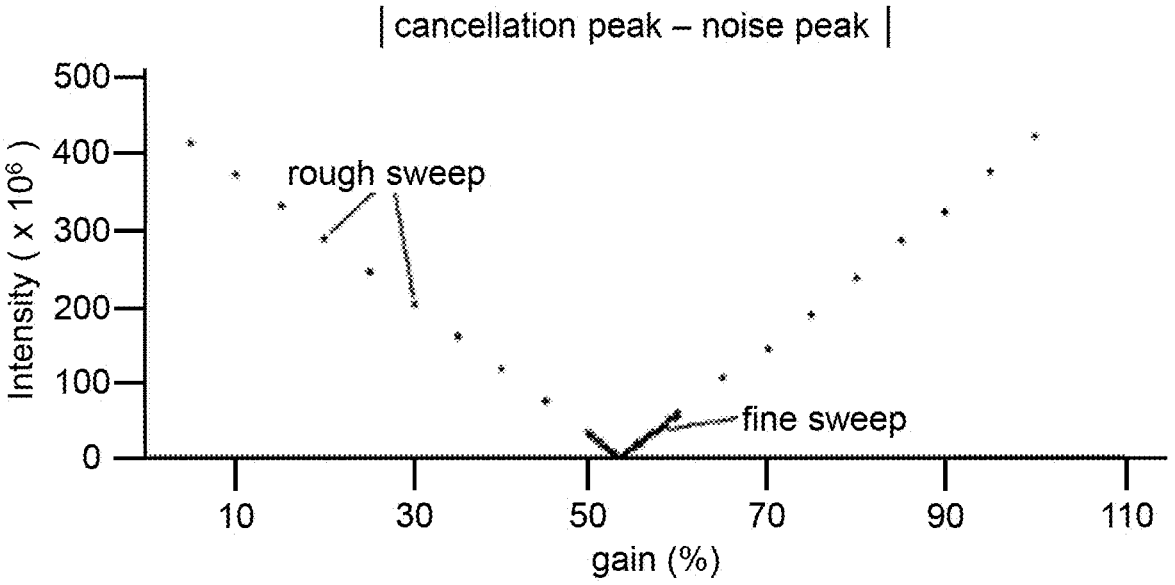
FIGS. 10A-10D depict an exemplary embodiment of calibrating control parameters of the conditioning module 115 for eliminating the crosstalk signal.

FIG. 10A shows a first step, which is a rough matching of the amplitudes of the added crosstalk signal 102 and the decoupled disturbance signal 10, when no sample is supplied to the mass analyser of a Fourier transform mass spectrometer. At first, the frequency of the electromagnetic disturbance can be identified in a measured mass spectrum, because this is the only detectable peak in the mass spectrum having the specific frequency of the electromagnetic disturbance 102. During the rough matching, the crosstalk compensation path is first switched off. Then, the amplitude of the disturbance signal 102 in the measured data signal 20 $V_{dist}$ can be determined. Following this, the crosstalk compensation path can be switched back on, and the signal data path can be switched off. The set parameter of the amplitude amplifier 160 can then be varied so that the amplitude of the compensation signal 16 is matching the amplitude of the measured data signal 20 $V_{dist}$. The match is found in FIG. 10A, showing the difference between both signals of the frequency of the detected electromagnetic disturbance 102, when the measured difference is roughly zero. This is also illustrated below as a step-by-step process.

Step 1. Rough matching of the amplitudes.

a. Switch off the crosstalk compensation path and identify the frequency of the investigated electromagnetic disturbance 102 (see FIG. 9A)
b. Determine the amplitude of the added crosstalk signal in the measured data signal 20 $V_{dist}$
c. Switch on the crosstalk compensation path again and switch off the signal data path (e.g. by switching off the preamplifier 150)
d. Vary the set parameter of the amplitude amplifier 160 to match the amplitude of the compensation signal 16 with the determined amplitude of the added crosstalk signal.

In a second step, a sweep through the settings of the phase shifter is made to investigate how the amplitude of the compensation signal 16 is influenced by the phase setting. Only the crosstalk compensation is switched on to condition the decoupled disturbance signal 10 extracted from the source of the electromagnetic disturbance 100. The detector unit 200 is switched off, and no measured data signal 20 is supplied to the adding module 200. First, for this measurement, the amplitude of the compensation signal 16 is set to a high value by a high value amplification by the amplitude amplifier 160. Then, the first phase shifter 140 is set from 0 to 127 consecutively two times, one time without a 180° phase shift by the inverter 120 ("signal 0") and one time without a 180° phase shift by the inverter 120 ("signal 1"). The change of the amplitude of compensation signal 16, which is the compensated signal 22 due to the switched off detector unit 200, is stored for each setting of the phase shifter. The same sweep is also made for the second phase shifter 142 and, accordingly, the change of the amplitude of compensation signal 16 is stored for each setting of the phase shifter. Based on this change of the amplitude, the amplification setting of the amplifier 160 is adjusted according to the used setting of the phase shifters to compensate the change of the amplitude of the compensation signal 16 with the setting of the phase shifters in the following steps of the calibration.

A step-by-step overview of this procedure also follows.

Step 2. Account for amplitude influence of the phase shifters e. Set amplitude of the compensation signal 16 to a high value
f. Set the setting of the first phase shifter 140 from 0 to 127 consecutively and store the change in the amplitude
g. Same as f. for phase shifter 142. From this point on, for each setting of phase shifters, the amplitude setting of the amplitude amplifier 160 is adjusted according to the factors measured in f. and g.

Figure 10B:
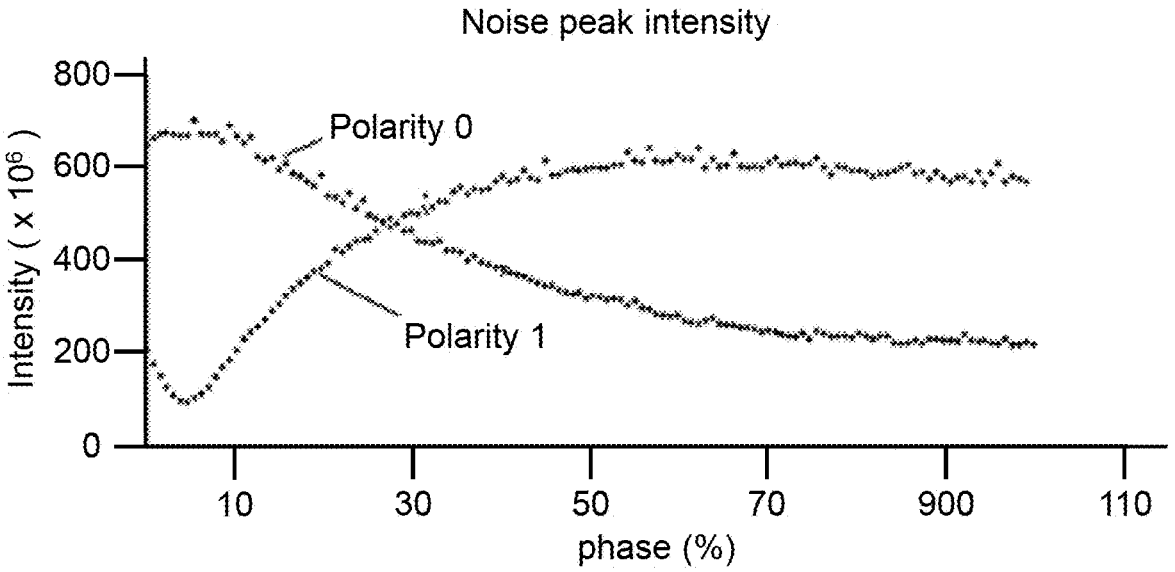
Figure 10C:
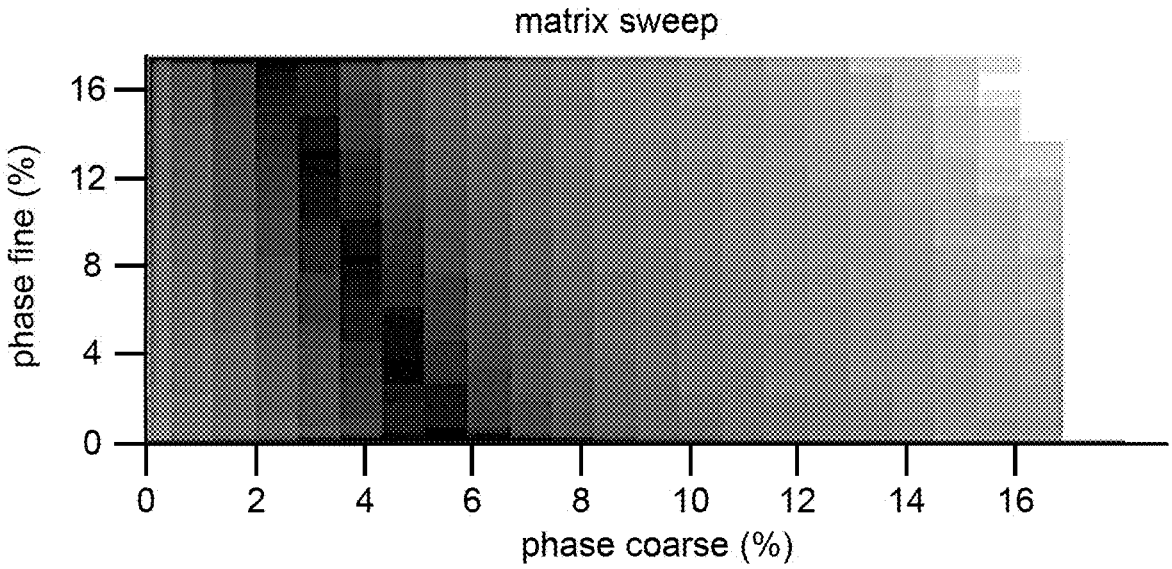

FIGS. 10B and 10C depict the third step of the calibration procedure, in which a best setting of the phase shifters to condition the decoupled disturbance signal (10) is found. Now, the crosstalk compensation and the detector unit 200 are switched on. For the amplifier 160 the set parameter defined in the first step is now used.

The inverter 120 is then set to 0°. Then the coarse phase shifter 140 is iterated from 0 to 127. Then, the inverter 120 is set to 180°, and the procedure is repeated.

In FIG. 10B, the amplitude of the compensated signal 22 is shown, which is related to the identified frequency of the electromagnetic disturbance 102 for both settings of the inverter 120 and each iteration. The appropriate phase shift can be identified by the minimum of the amplitude of the compensated signal 22, which is given by a 180° phase shift of the inverter 120 and an additional phase shift of roughly 4% by the first phase shifter 140. Following this, both the inverter and the phase shifter are set to these values where the absolute minimum was achieved.

FIG. 10C is showing a fine sweep through the phases to find a minimum represented by darker colours in the colour map. Both phase shifters 140 and 142 are now varied by a few steps around the minimum identified before, and the minimum is determined again.

Step 3. Determine best setting for phase shifters h. Switch on the signal data path again, and set the amplitude of the compensation signal 16 to the value determined in d.

i. Set inverter 120 to 0° and iterate both phase shifters 140 and 142 from 0 to 127 simultaneously. Find the minimum for the disturbing signal in spectrum.

j. Same as in i., but with the inverter set to 180°.

k. Set the inverter and the shifters to the values where the minimum was found.

l. Vary in a range of a few steps both shifters 140 and 142 separately and find the minimum. For example, if the minimum was found at the setting 32, look in the range [16 . . . 48]×[16 . . . 48] for phase shifters 140 and 142 accordingly.

Figure 10D:
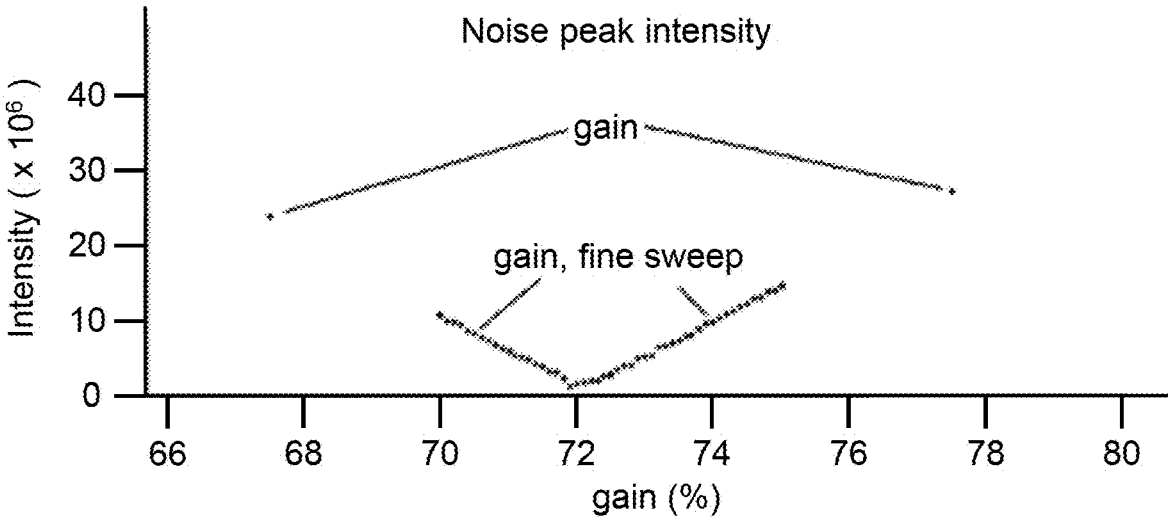

FIG. 10D depicts the fourth step of the calibration procedure comprising a fine matching of the amplitudes of the added crosstalk signal 102 and the decoupled disturbance signal 10 with the newfound matching phases. During this stage, the set parameter of the amplifier 160 is again varied, with the more precise matching phases as found previously in the description to FIG. 10C. In FIG. 10D, the intensity of the compensated signal 22 of the frequency of the investigated electromagnetic disturbance 102 is shown. Because these measurements are performed without a sample, the compensation of the added crosstalk signal induced by the investigated electromagnetic disturbance by the compensation signal 16 due to the set parameter is shown. In this way, the optimised parameters of the amplifier 160 can be identified at the values corresponding to the intensity of the compensated signal 22 being reduced to essentially zero.

Step 4. Fine matching of the amplitudes.

m. Repeat d. with the best-found setting for the shifters.

In Table 1 below, some of the terms used in the present document are explained, defined and/or exemplified. The given definitions and examples are not exclusive and are given merely for the user's convenience and understanding.

TABLE 1

| Definitions of Terms and Components | |
|---|---|
| Source of an electromagnetic disturbance 100 | e.g. RF power supply of a quadrupole filter, the electrodes of a quadrupole, which is emitting an electromagnetic disturbance 102. |
| Electromagnetic disturbance 102 | Emitted signal of a source of electromagnetic disturbance 100 influencing the measured data signal 20 of a detector unit 200, in particular of a Fourier transform mass spectrometer. |
| Detector unit 200 | Unit, in particular of a Fourier transform mass spectrometer, measuring a data signal, generated by an image current, in particular induced by ions in a mass analyser, whereby the unit may comprise further components like a preamplifier to change the image current into a measured data signal. |
| Measured data signal 20 | Signal measured by the detector unit 200 provided by in interface to the periphery. |
| Undisturbed measured data signal 18 | Signal measured by the detector unit 200 provided by an interface to the periphery, when no source of an electromagnetic disturbance is influencing the measured data signal 20. |
| Crosstalk | Interaction, in particular interference, between an electromagnetic disturbance and a detector unit modifying the measured data signal in comparison to the undisturbed measured data signal. In particular, it can be a superposition of at least a part of the electromagnetic disturbance with the undisturbed measured data signal. |
| Added crosstalk signal | Signal added to the undisturbed measured data signal by the crosstalk of an electromagnetic disturbance and the detector unit resulting in the measured data signal. |

TABLE 1-continued

| Definitions of Terms and Components | |
|---|---|
| | undisturbed data measured data + added crosstalk signal = measured data signal |
| Extraction device 103 | Device which extracts a signal from a source of an electromagnetic disturbance, the decoupled disturbance signal 10, which is correlated to the electromagnetic disturbance having the same shape and frequency and being correlated to the amplitude of the electromagnetic disturbance. |
| Decoupled disturbance signal 10 | Signal extracted by an extraction device 103 from a source of an electromagnetic disturbance which is correlated to the electromagnetic disturbance 102 having the same shape and frequency and being correlated to the amplitude of the electromagnetic disturbance. |
| Conditioning module 115 | Module, to which a decoupled disturbance signal 10 is provided. The conditioning module 115 is conditioning the decoupled disturbance signal 10 to obtain the compensation signal 16 by applying only a phase shift and/or an amplitude amplification to the decoupled disturbance signal 10. Preferably, the condition module comprises both components: phase shifter 170 and amplification module 160. |
| Phase shifter 170 | The phase shifter has two functions. It inverts the decoupled disturbance signal 10 and compensates any phase difference $\Delta\varphi$, which the compensation signal 16 and the measured data signal 20 would have at the adding module 220, which is different from 180°, by an additional phase shift $-\Delta\varphi$. In general, an essential phase inversion of the compensation signal is sufficient to eliminate the added crosstalk signals according to the invention. |
| $\varphi_{ms}$ | phase angle of the measured data signal 20 at the adding module 220 |
| $\varphi_{cs}$ | phase angle of the compensation signal 16 superposed to the measured data signal 20 at the adding module 220 |
| $\varphi_{cs} - \varphi_{ms}$ | = 180° |
| $\varphi_{inv}$ | phase angle of the compensation signal 16 at the adding module 220 without additional phase shift, if only a phase shift of 180° is applied to the decoupled disturbance signal 10 |
| $\varphi_{inv} - \varphi_{ms}$ | = 180° + $\Delta\varphi$ |
| Amplification module 160 | The amplifier 160 modifies the amplitude of the decoupled disturbance signal as part of the conditioning module 115, so that the amplitude of the decouple disturbance signal matches the amplitude of the compensation signal 16. |
| Compensation signal 16 | The compensation signal 16 is provided by the conditioning module 115 when a decoupled disturbance signal 10 is provided to the conditioning module 115. |
| Adding module 220 | The measured data signal 20 and the compensation signal 16 are provided to the adding module 220, preferably at one junction 600. Both signals are superposed to obtain the compensated data signal 22 by the adding module, which is essentially the same signal, which would be provided by the detector unit 200 without any interference from the source of electromagnetic disturbance 100. |
| Compensated signal 22 | The compensated signal 22 is provided by the adding module 220 and is essentially the same signal, which would be provided by the detector unit 200 without any source of electromagnetic disturbance 100. |

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components if not in detail stated in the description.

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

What is claimed is:

1. A signal processing unit comprising:

(a). at least one measured data signal input line adapted to receive a measured data signal generated by an image current, wherein the measured data signal comprises an added crosstalk signal induced by a source of electromagnetic disturbance;

(b). at least one disturbance signal input line adapted to receive a decoupled disturbance signal, extracted from the source of electromagnetic disturbance by an extraction device;

(c). an output line adapted to supply a compensated data signal to at least one data receiving device;

(d). a conditioning module, to which the decoupled disturbance signal is supplied via the disturbance signal input line and which provides a compensation signal; and (e). an adding module, to which the measured data signal and the compensation signal are provided and in which the measured data signal and the compensation signal are superposed, whereby the decoupled disturbance signal is conditioned by the conditioning module in such a way that the compensation signal essentially corresponds to an inverted added crosstalk signal.

2. The signal-processing unit according to claim 1 wherein the data signal input line is connected to a detector unit of a Fourier transform mass spectrometer supplying the measured data signal.

3. The signal-processing unit according to claim 1 wherein the disturbance signal input line is connected to the extraction device extracting the decoupled disturbance signal from the source of electromagnetic disturbance.

4. The signal-processing unit according to claim 3 wherein the extraction device comprises an impedance component.

5. The signal-processing unit according to claim 4 wherein the extraction device comprises an antenna adapted to detect the decoupled disturbance signal.

6. The signal-processing unit according claim 4 wherein the extraction device comprises an additional winding of a transformer.

7. The signal-processing unit according to claim 1, wherein the conditioning module comprises at least a phase shifter, and at least an amplification module.

8. The signal-processing unit according to claim 1, wherein the conditioning module is digitally controlled.

9. The signal-processing unit according to claim 1, wherein the decoupled disturbance signal in a form of analogous signal is conditioned by adjusting the phase and/or the amplitude of the decoupled disturbance signals to obtain the compensation signal.

10. The signal processing unit according to claim 1 wherein the adding module further comprises a junction to which the adding module is adapted to supply both the measured data signal and the compensation signal in order to superpose them.

* * * * *